US009927158B2

(12) United States Patent
Martin

(10) Patent No.: US 9,927,158 B2
(45) Date of Patent: Mar. 27, 2018

(54) REFRIGERATION SYSTEM WITH INTEGRATED CORE STRUCTURE

(71) Applicant: Dana Canada Corporation, Oakville (CA)

(72) Inventor: Michael A. Martin, Hamilton (CA)

(73) Assignee: Dana Canada Corporation, Oakville (CA)

( * ) Notice: Subject to any disclaimer, the term of this patent is extended or adjusted under 35 U.S.C. 154(b) by 48 days.

(21) Appl. No.: 15/282,212

(22) Filed: Sep. 30, 2016

(65) Prior Publication Data

US 2017/0097179 A1 Apr. 6, 2017

Related U.S. Application Data

(60) Provisional application No. 62/236,398, filed on Oct. 2, 2015.

(51) Int. Cl.

| | |
|---|---|
| ***F25B 39/00*** | (2006.01) |
| ***F25B 41/06*** | (2006.01) |
| *F25B 39/02* | (2006.01) |

(52) U.S. Cl.

CPC ..... *F25B 39/00* (2013.01); *F25B 41/062* (2013.01); *F25B 39/022* (2013.01); *F25B 2339/043* (2013.01); *F25B 2339/047* (2013.01); *F25B 2500/18* (2013.01)

(58) Field of Classification Search

CPC .. F25B 39/00; F25B 41/062; F25B 2339/043; F25B 2339/047; F25B 2500/18; F25B 39/022

See application file for complete search history.

(56) References Cited

U.S. PATENT DOCUMENTS

| | | | |
|---|---|---|---|
| RE35,890 | E | 9/1998 | So |
| 6,273,183 | B1 | 8/2001 | So et al. |
| 2009/0120630 | A1 | 5/2009 | Pun |
| 2009/0178435 | A1 | 7/2009 | Hiyama |

(Continued)

FOREIGN PATENT DOCUMENTS

| | | | |
|---|---|---|---|
| CA | 2925508 | A1 | 4/2015 |
| CN | 101514831 | A | 8/2009 |
| WO | 02063223 | A1 | 8/2002 |

OTHER PUBLICATIONS

International Search Report and Written Opinion for Application No. PCT/CA2016/051142, dated Dec. 12, 2016, issued by the Canadian Intellectual Property Office.

*Primary Examiner* — Emmanuel Duke
(74) *Attorney, Agent, or Firm* — Marshall & Melhorn, LLC

(57) ABSTRACT

A refrigeration system includes a core comprising a stack of core plates. The core defines a condenser, an evaporator and a refrigerant reservoir. The condenser has a plurality of refrigerant flow passages and a plurality of first coolant flow passages in alternating arrangement. The evaporator has a plurality of refrigerant flow passages and a plurality of second coolant flow passages in alternating arrangement. The condenser has a refrigerant outlet in flow communication with the refrigerant inlet of the refrigerant reservoir, where the refrigerant side of at least one of said core plates includes a refrigerant communication passage providing flow communication between the refrigerant outlet of the condenser section and the refrigerant inlet of the reservoir section.

20 Claims, 28 Drawing Sheets

(56) References Cited

U.S. PATENT DOCUMENTS

| | | | | |
|---|---|---|---|---|
| 2012/0060550 | A1* | 3/2012 | Mann | F25B 39/00 62/513 |
| 2013/0133359 | A1 | 5/2013 | Ueda et al. | |

* cited by examiner

REFRIGERATION SYSTEM WITH INTEGRATED CORE STRUCTURE

CROSS-REFERENCE TO RELATED APPLICATION

This application claims priority to and the benefit of U.S. Provisional Patent Application No. 62/236,398 filed Oct. 2, 2015, the contents of which are incorporated herein by reference.

FIELD OF THE INVENTION

The invention generally relates to refrigeration systems, and more particularly to refrigeration systems comprising a number of components integrated into a compact core structure.

BACKGROUND OF THE INVENTION

Refrigeration systems include a number of components, including a compressor, a condenser, an evaporator, a thermal expansion valve and a refrigerant reservoir for storing pressurized liquid refrigerant condensed in the condenser. A liquid coolant such as a water/glycol mixture may be circulated through the condenser and the evaporator, removing heat from the pressurized refrigerant in the condenser, and transferring heat to the expanding refrigerant in the evaporator. The heated coolant from the condenser may then be passed through a heat exchanger to release heat to the environment, and the chilled coolant from the evaporator may be used for cooling another fluid or a heat-producing component. For example, such refrigeration systems can be used for production of chilled air in an air conditioning system, or for cooling of heat-producing components such as batteries.

The components of refrigeration systems are typically provided as separate components, and the coolant and refrigerant connections between the various components are provided by tubes or hoses. In many applications, such as in vehicular systems, these components must all fit within a finite space. Therefore, in order to save space, reduce cost, and simplify the complex nature of these systems, it would be desirable to integrate two or more components of such air conditioning systems into a compact package. Integration also provides more direct connections between the components, which can reduce the number of fluid connections within the system to reduce the number of leak points between components, and to minimize the overall volume of refrigerant contained in the system.

SUMMARY OF THE INVENTION

In an embodiment, there is provided a refrigeration system comprising a core. The core comprises a stack of core plates and defines: (a) a condenser comprising a plurality of refrigerant flow passages and a plurality of first coolant flow passages in alternating arrangement throughout said core, the condenser further comprising a refrigerant inlet, a refrigerant outlet, a first coolant inlet, and a first coolant outlet; (b) an evaporator comprising a plurality of refrigerant flow passages and a plurality of second coolant flow passages in alternating arrangement throughout said core, the evaporator further comprising a refrigerant inlet, a refrigerant outlet, a second coolant inlet, and a second coolant outlet; and (c) a refrigerant reservoir having a refrigerant inlet and a refrigerant outlet. The refrigerant outlet of the condenser is in flow communication with the refrigerant inlet of the refrigerant reservoir, and the refrigerant outlet of the refrigerant reservoir is in flow communication with the refrigerant inlet of the evaporator.

Each of the core plates has a refrigerant side and a coolant side and includes a plurality of partitions on both its refrigerant side and its coolant side, said plurality of partitions dividing the core plate into a condenser section, an evaporator section and a reservoir section. The condenser section of each said core plate comprises a condenser wall separating the refrigerant flow passages of the condenser from the first coolant flow passages, wherein the condenser sections of the core plates are aligned throughout the core. The evaporator section of each said core plate comprises an evaporator wall separating the refrigerant flow passages of the evaporator from the second coolant flow passages, wherein the evaporator sections of the core plates are aligned throughout the core. The refrigerant reservoir section of each said core plate comprises an aperture, wherein said apertures are aligned throughout the core. The refrigerant side of at least one of said core plates includes a refrigerant communication passage providing flow communication between the refrigerant outlet of the condenser section and the refrigerant inlet of the reservoir section.

In an embodiment, one of said partitions on the refrigerant side divides the condenser section from the refrigerant reservoir, and wherein the refrigerant communication passage comprises an interruption in at least one of said partitions.

In an embodiment, the condenser wall of each said core plate has a first refrigerant opening and a second refrigerant opening, and wherein the first refrigerant openings align throughout the core to form a first refrigerant manifold space of the condenser, and wherein the second refrigerant openings align throughout the core to form a second refrigerant manifold space of the condenser.

In an embodiment, at least one of the first refrigerant manifold space and the second refrigerant manifold space includes an internal partition so as to direct flow of the refrigerant to follow a multi-pass refrigerant flow path through the condenser. The multi-pass refrigerant flow path includes a first pass in which the refrigerant inlet of the condenser is located, and a last pass in which the refrigerant outlet of the condenser is located; and the last pass is comprised of said at least one core plate including a refrigerant communication passage, and the other passes of the multi-pass refrigerant flow path are comprised of core plates in which the condenser is sealed from the refrigerant reservoir by at least one of said partitions.

In an embodiment, the refrigerant inlet of the condenser is located above the refrigerant outlet of the condenser.

In an embodiment, the refrigerant outlet of the refrigerant reservoir is located below the refrigerant inlet of the refrigerant reservoir.

In an embodiment, the refrigerant reservoir is located below the evaporator, and wherein the evaporator inlet is located below the evaporator outlet.

In an embodiment, the flow communication between the refrigerant outlet of the refrigerant reservoir and the refrigerant inlet of the evaporator is provided through a return passage located outside the core. In an embodiment, the refrigeration system further comprises a thermal expansion valve located in the return passage between the refrigerant outlet of the refrigerant reservoir and the refrigerant inlet of the evaporator. In an embodiment, the thermal expansion valve is located in an upper portion of the core, and wherein the refrigeration system further comprises an external passage for delivering the refrigerant from the thermal expansion valve to the refrigerant inlet of the evaporator.

In an embodiment, each of the core plates further comprises a peripheral flange, and wherein the peripheral flanges of adjacent core plates in said core are sealingly joined together.

In an embodiment, corresponding partitions of adjacent core plates are sealingly joined together so as to provide separation of the condenser section, the evaporator section and the refrigerant reservoir from one another.

In an embodiment, the refrigeration system further comprises a back plate and a front plate, wherein one of the back plate and the front plate includes an external inlet connection for the refrigerant, wherein the external inlet connection provides flow communication with the refrigerant inlet of the condenser. In an embodiment, the refrigeration system further comprises a compressor having an inlet in flow communication with the refrigerant outlet of the evaporator and an outlet in flow communication with the external inlet connection of the front plate. In an embodiment, the front plate is further provided with a plurality of coolant fittings, each of which is in flow communication with one of the first coolant inlet, the first coolant outlet, the second coolant inlet and the second coolant outlet.

BRIEF DESCRIPTION OF THE DRAWINGS

The embodiments will now be described, by way of example only, with reference to the accompanying drawings in which.

DETAILED DESCRIPTION

A refrigeration system 10 according to a first embodiment is now described with reference to FIGS. 1 to 16.

Figure 1:
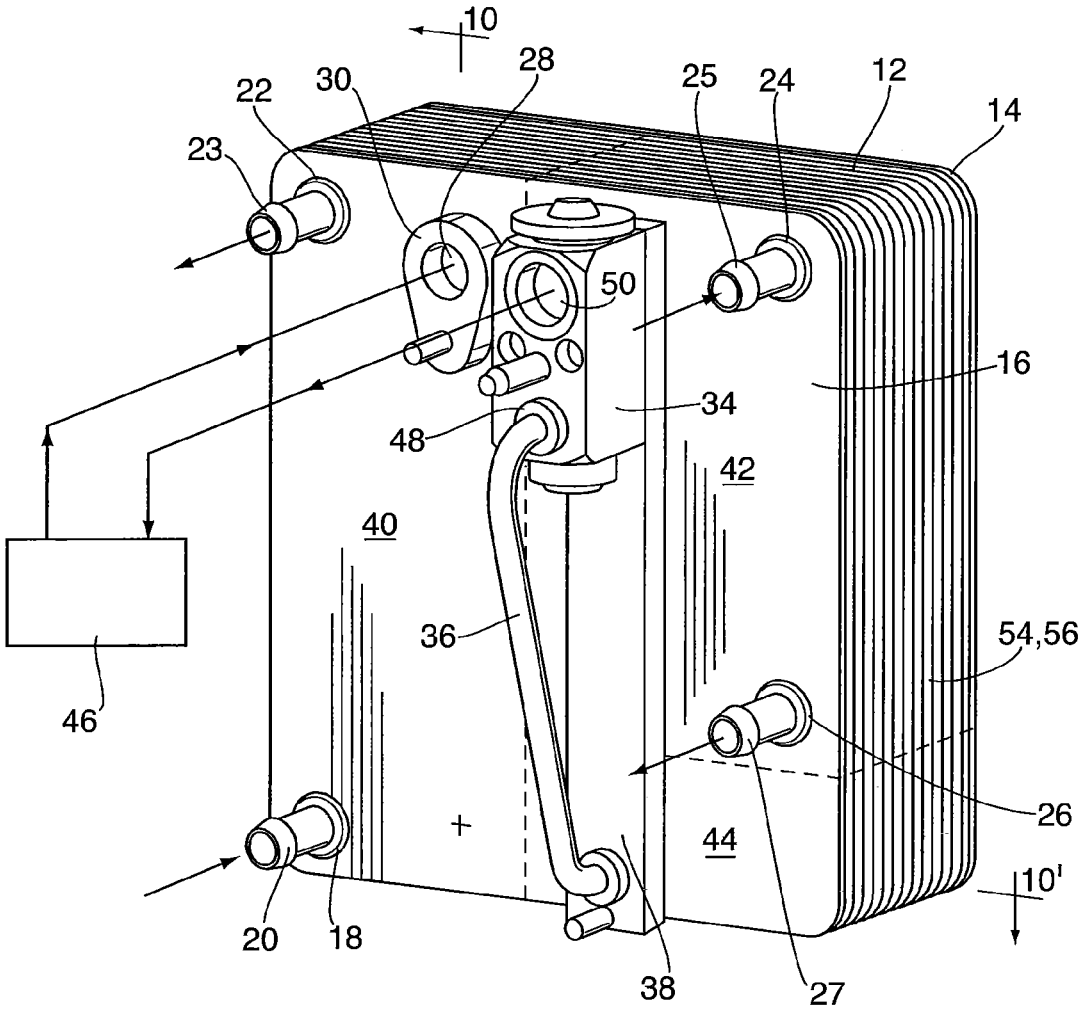
FIG. 1 is a front perspective view of a refrigeration system according to a first embodiment described herein.
Figure 2:
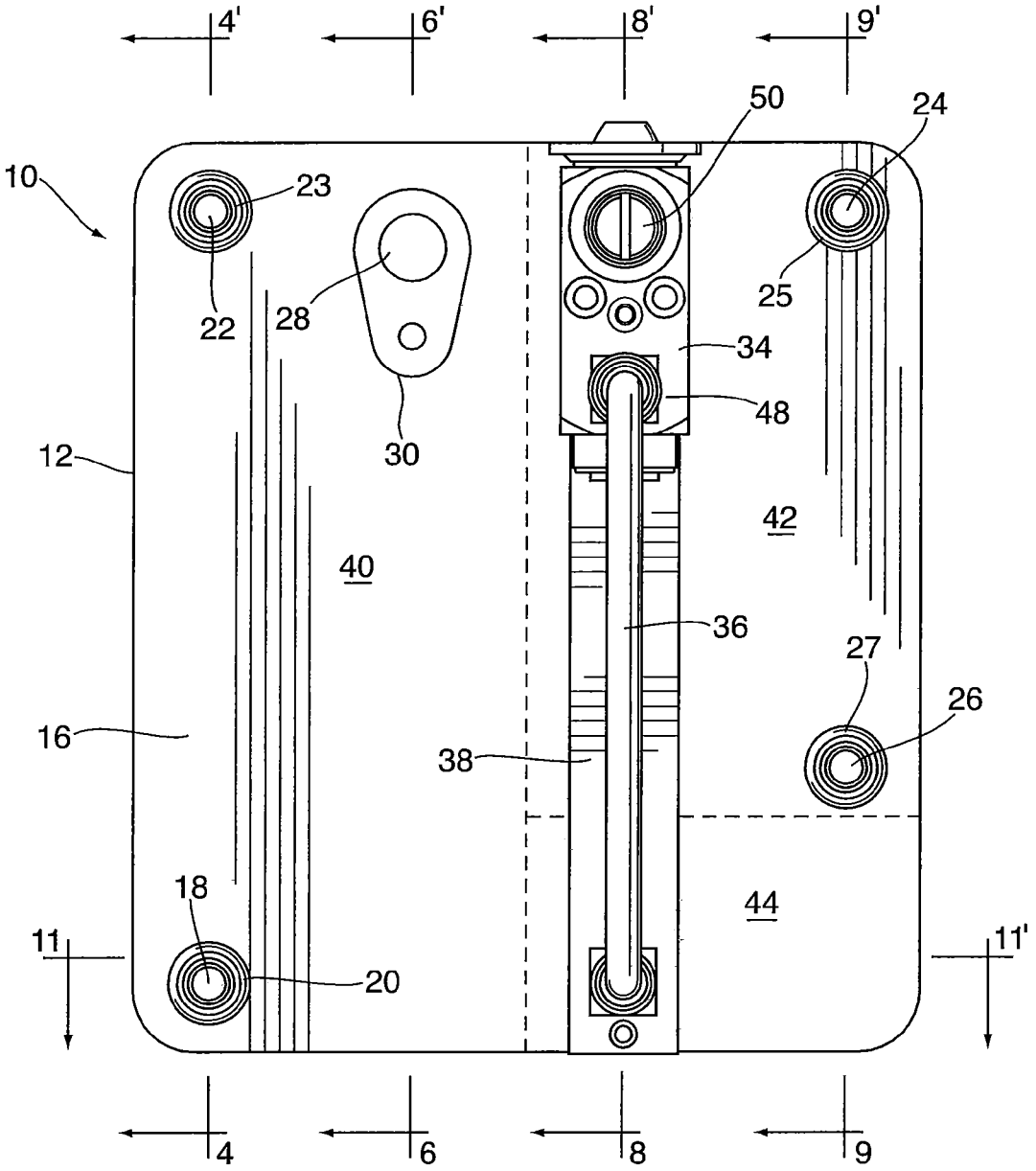
FIG. 2 is front plan view of the integrated core structure of the refrigeration system of FIG. 1.

FIG. 1 shows the external appearance of the refrigeration system 10, which includes an integrated core structure 12 (also referred to herein as "core 12") and a compressor 46. FIG. 2 shows the core 12 in isolation, i.e. without the compressor 46. The core comprises a stack of core plates 54, 56 sandwiched between a back plate 14 and a front plate 16, wherein the thickness of the back and front plates 14, 16 may be greater than that of the core plates 54, 56 in core 12, so as to provide the core 12 with structural rigidity.

The refrigeration system 10 and core 12 are shown in FIGS. 1 and 2 in the approximate orientation they will have when installed in a vehicle.

In the present embodiment, the back plate 14 is free of perforations, and the front plate 16 is provided with a plurality of refrigerant and coolant connections, as discussed below. However, the location of the refrigerant and coolant connections is largely a function of specific spatial requirements and may vary from one application to another. Therefore, although the drawings show all coolant and refrigerant connections on the front plate 16, some or all of the connections may instead be provided on the rear plate 14.

There are three components of the refrigeration system 10 integrated within the core 12, namely a condenser 40, an evaporator 42 and a refrigerant reservoir 44. The approximate divisions between the condenser 40, evaporator 42 and refrigerant reservoir 44 are indicated by dotted lines in FIGS. 1 and 2.

The core 12 include a condenser coolant inlet 18 (also referred to herein as the "first coolant inlet") provided in the front plate 16, in the portion of the refrigeration system 10 defining the condenser 40. A condenser coolant inlet fitting 20 is sealingly attached to the condenser coolant inlet 18. A condenser coolant outlet 22 (also referred to herein as the "first coolant outlet") is also provided in the front plate 16 in the portion of core 12 defining the condenser 40. A condenser coolant outlet fitting 23 is sealingly attached to the condenser coolant outlet 22. The condenser coolant inlet and outlet fittings 20, 23 are shown as comprising cylindrical tubes having hose barbs for connection to external coolant lines of the vehicle's coolant circulation system.

In the illustrated embodiment, the condenser coolant inlet 18 is close to the bottom of core 12 and condenser 40, while the condenser coolant outlet 22 is close to the top of core 12 and condenser 40. Therefore, in the present embodiment, the coolant flows upwardly from the bottom to the top of condenser 40. However, it will be appreciated that the direction of coolant flow through the condenser 40 may instead be from top to bottom. The condenser coolant inlet 18 receives a liquid coolant, which can be a glycol/water coolant from a coolant circulation system, and the coolant is returned to the coolant circulation system from the condenser coolant outlet 22.

FIGS. 1 and 2 also show that the core 12 includes an evaporator coolant inlet 24 (also referred to herein as the "second coolant inlet") and an evaporator coolant outlet 26 (also referred to herein as the "second coolant outlet") provided in the front plate 16, in the portion of core 12 defining the evaporator 42. An evaporator coolant inlet fitting 25 is sealingly attached to the evaporator coolant inlet 24, and an evaporator coolant outlet fitting 27 is sealingly attached to the evaporator coolant outlet 26. The evaporator coolant inlet and outlet fittings 25, 27 have the same configuration as the condenser coolant fittings 20, 23 described above.

The evaporator coolant inlet 24 is shown as being close to the top of the evaporator 42 and the top of core 12. The evaporator coolant outlet 26 is shown as being close to the bottom of evaporator 42, so that the coolant will flow downwardly through the evaporator 42. However, it will be appreciated that the direction of coolant flow through the evaporator may be reversed, so that the coolant flows from the bottom to the top of the evaporator 42. The evaporator coolant inlet 24 receives a liquid coolant, such as a glycol/water coolant, from a coolant circulation system, and the coolant is returned to the coolant circulation system from the evaporator coolant outlet 22. It will be appreciated that the condenser 40 and the evaporator 42 may be connected to the same coolant circulation system.

As shown in FIGS. 1 and 2, the core further comprises a refrigerant inlet 28 provided in the front plate 16, in the portion of core 12 defining the condenser 40. A refrigerant inlet fitting 30 is sealingly attached to the refrigerant inlet 28. In use, a pressurized gaseous refrigerant from the outlet of compressor 46 is fed to the condenser 40 through the refrigerant inlet fitting 30 and inlet 28. As the refrigerant flows through the condenser 40, it is cooled and condensed by heat transfer to the coolant, causing it to condense. The coolant absorbs heat from the refrigerant and therefore the temperature of the coolant exiting condenser 40 through outlet 22 is higher than that of the coolant entering condenser 40 through inlet 18.

A refrigerant outlet permitting flow of the condensed refrigerant from the condenser 40 to the refrigerant reservoir 44 is contained within the core 12, and is therefore not visible in FIGS. 1 and 2. This is discussed further below.

Also shown in FIGS. 1 and 2 are a thermal expansion valve 34 for metering refrigerant into the evaporator 42, a return tube 36 for conveying the condensed refrigerant from the refrigerant reservoir 44 to the evaporator 42, and a mounting block 38, all of which form part of the integrated core structure 12 and are provided on the front plate 16.

The thermal expansion valve 34 may comprise an industry-standard automotive thermal expansion valve having a first port 48 and a second port 50. The valve 34 meters the flow of liquid refrigerant into evaporator 42 through first port 48 based on conditions monitored at the second port 50. In this regard, pressurized liquid refrigerant from the refrigerant reservoir 44 flows to the first port 48 of valve 34 through the return tube 36, where it is metered into the low pressure side of the system, namely into a refrigerant inlet of the evaporator 42, which is not visible in FIGS. 1 and 2, but which is located proximate to the bottom of front plate 16. The refrigerant evaporates as it passes upwardly through the evaporator 42, then exits the core 12 through the second port 50 of the thermal expansion valve 34, and flows to the inlet of compressor 46.

As it evaporates (i.e. boils) in the evaporator 42, the refrigerant extracts heat from the coolant flowing through the evaporator 42. The chilled coolant exiting the evaporator 42 is returned to the coolant circulation system and may be used to cool another fluid, and/or to cool a heat-producing component, as discussed above.

Figure 3:
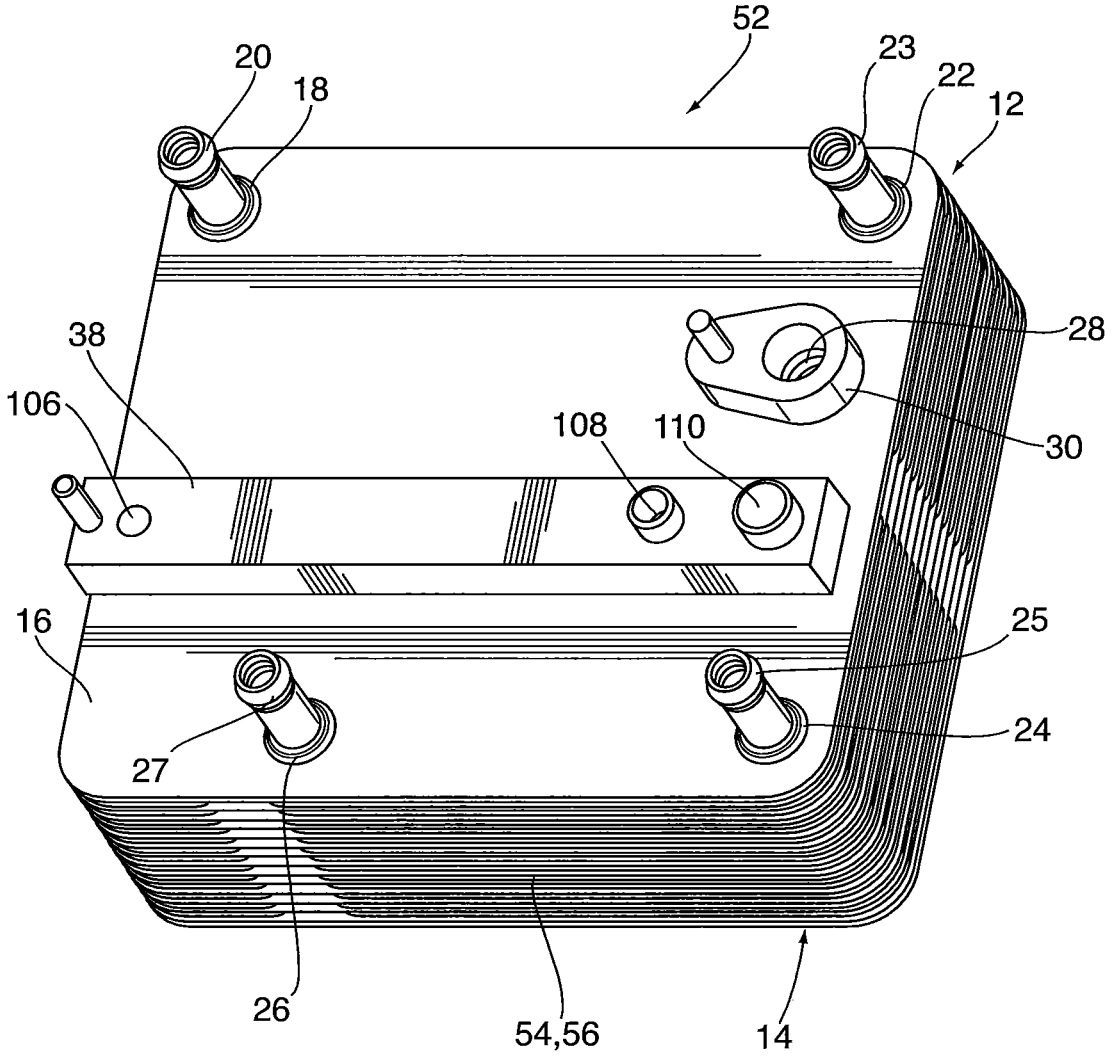
FIG. 3 is a front perspective view showing a brazed assembly of parts for the integrated core structure of FIG. 2.

It can be seen that the refrigeration system 10 and core 12 shown in FIGS. 1 and 2 have a compact structure, with at least some of the fluid connections being provided within the structure of core 12. Furthermore, it will be appreciated that the refrigeration system 10 and core 12 contain relatively few components, and that most of the components illustrated in FIG. 1 can be assembled in a single operation. For example, where the plates making up core 12, mounting block 38, refrigerant inlet fitting 30 and coolant fittings 20, 23, 25, 27 are comprised of a brazeable metal such as aluminum and/or an aluminum alloy, these components can all be assembled in a single brazing operation in a brazing furnace. FIG. 3 illustrates a brazed assembly produced in this single brazing operation from the above-mentioned components. Thus, it can be seen that the refrigeration system 10 and core 12 shown in the drawings provide substantial benefits in terms of simplicity, cost and manufacturability, in comparison with air conditioning systems where one or more of the condenser, evaporator and refrigerant reservoir are provided as separate components. For example, the integration of the components provides substantial savings in tooling costs, since one set of dies can be used to produce the condenser 40, evaporator 42 and reservoir 44.

Figure 4:
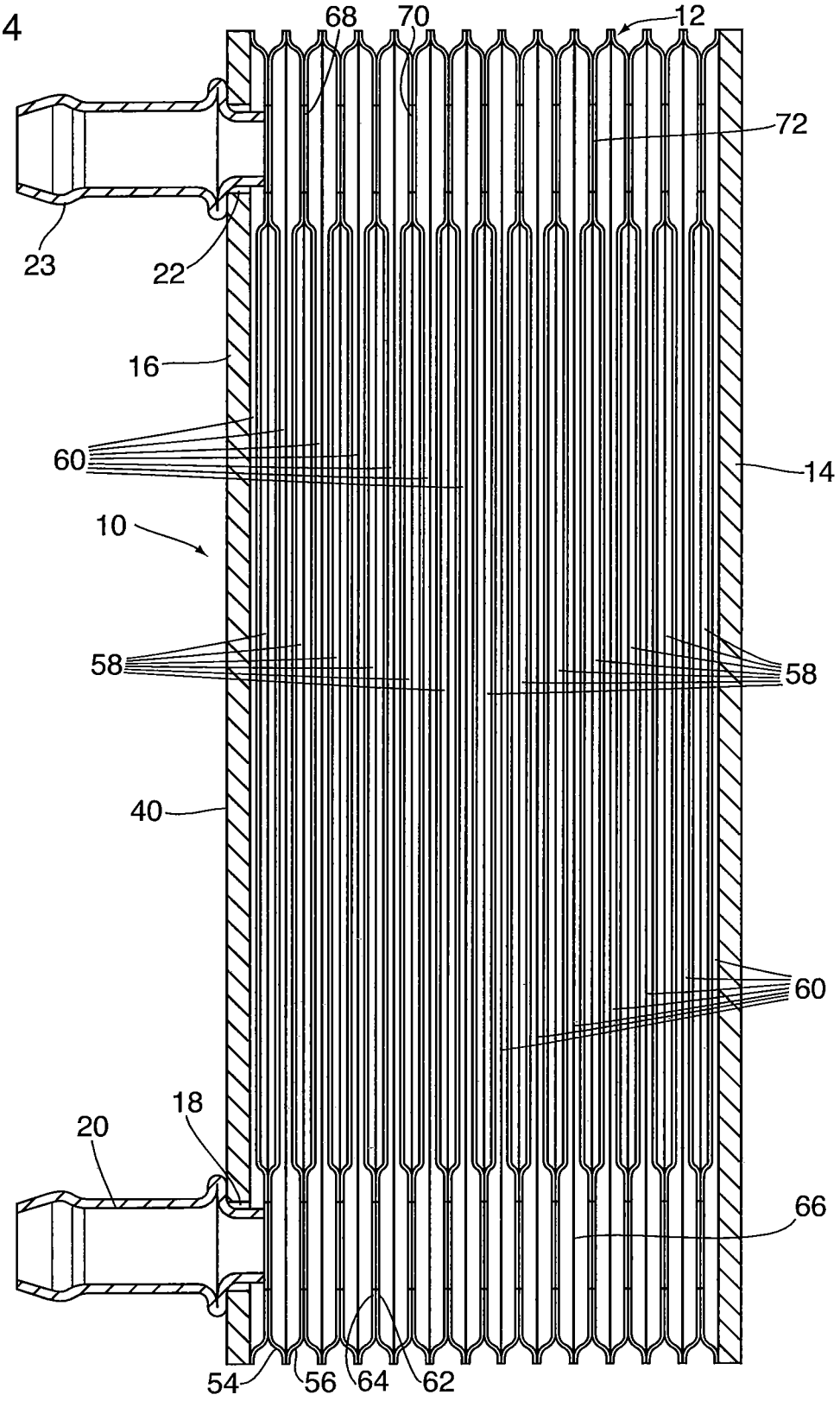
FIG. 4 is a cross-section along line 4-4' of FIG. 2.
Figure 5:
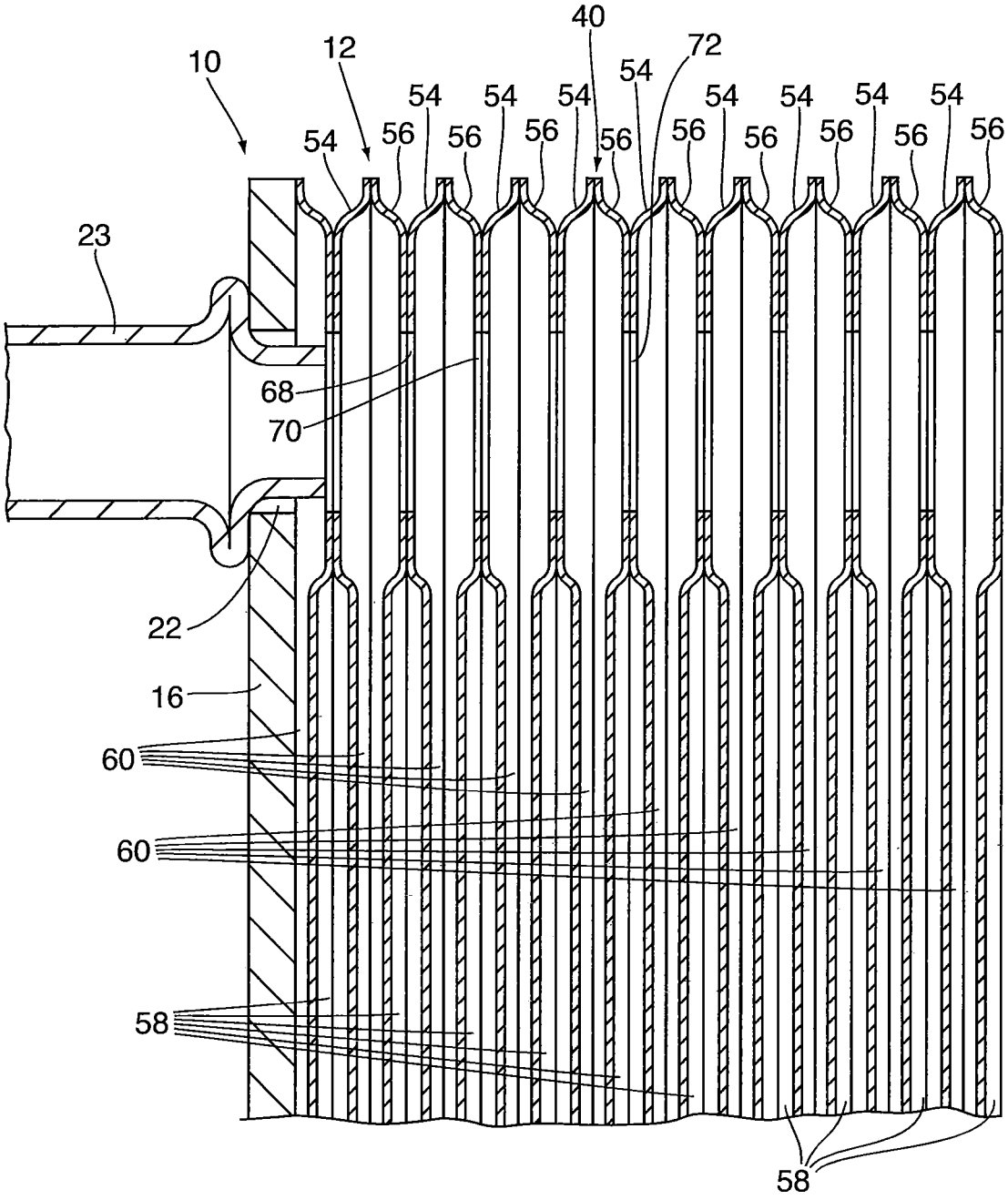
FIG. 5 is an enlarged view of a portion of FIG. 4.

FIG. 4 shows a cross-section through the refrigeration system 10 along line 4-4' of FIG. 2, wherein the plane of the cross-section passes through the condenser 40, and through the condenser coolant inlet 18 and inlet fitting 20, and through the condenser coolant outlet 22 and outlet fitting 23. FIG. 5 is a close-up of a portion of FIG. 4, showing the top portion of condenser 40.

As can be seen from the drawings, the core 12 is made up of a plurality of core plates of two different types, referred to herein as the first core plate 54 and the second core plate 56. The first and second core plates 54, 56 are shown in isolation in FIGS. 12 and 15, respectively.

As shown in FIG. 4 and in the close-up of FIG. 5, the core 12 of core plates 54, 56 defines alternating refrigerant flow passages 58 and coolant flow passages 60 within the condenser 40. The first and second core plates 54, 56 are provided with coolant inlet openings 62, 64, respectively, which align with one another throughout the core 12 so as to form a coolant inlet manifold 66 in the condenser 40.

Similarly, the first and second core plates 54, 56 are provided with coolant outlet openings 68, 70, respectively, which are aligned throughout the core 12 to form a coolant outlet manifold 72 in the condenser 40. As can be seen from FIG. 4, the respective coolant inlet and outlet manifolds 66, 72 are closed at one end by the back plate 14, and are open at the other end to the respective condenser coolant inlet and outlet, 18, 22. Therefore, the coolant enters the coolant inlet manifold 66 through the condenser coolant inlet 18, flows through the coolant flow passages 60 to the coolant outlet manifold 72, and then exits the condenser 40 through the condenser coolant outlet 22.

Figure 6:
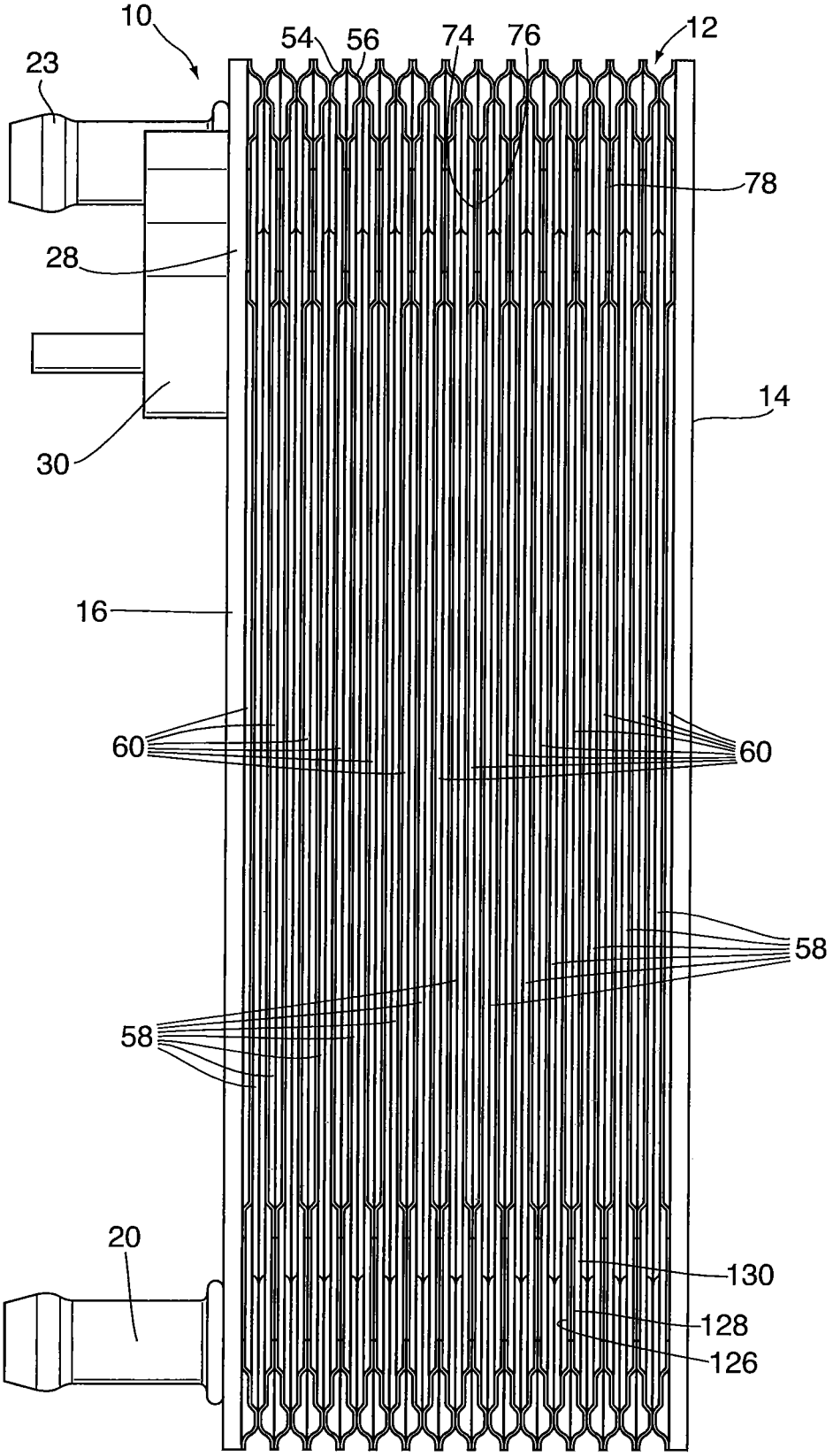
FIG. 6 is a cross-section along line 6-6' of FIG. 2.
Figure 7:
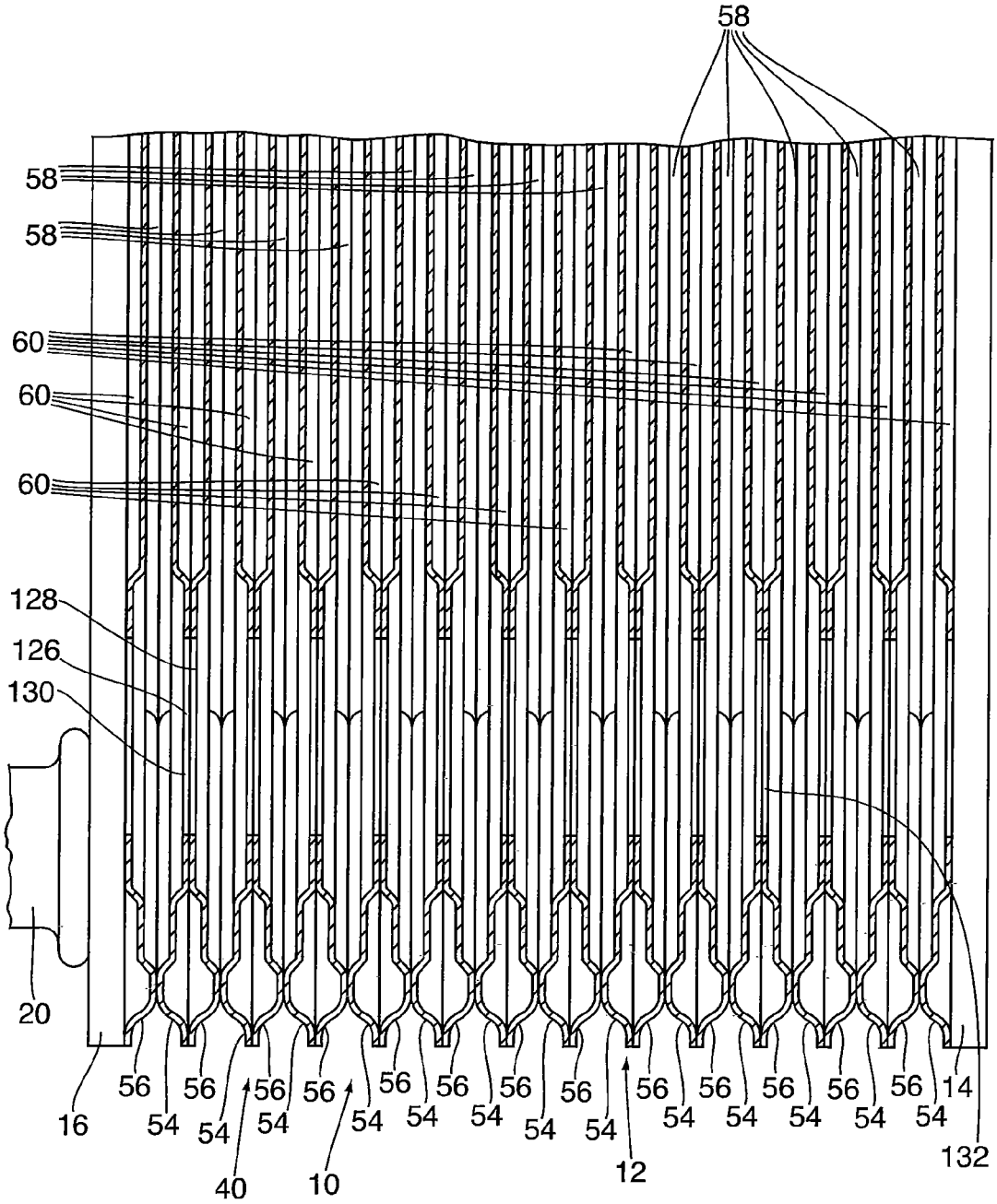
FIG. 7 is an enlarged view of a portion of FIG. 6.

FIG. 6 shows a cross-section along line 6-6' of FIG. 2, wherein the plane of the cross-section of FIG. 6 passes through the refrigerant inlet 28 and the refrigerant inlet fitting 30 of the condenser 40. FIG. 7 is a close-up of a portion of FIG. 6, showing the bottom portion of condenser 40. As can be seen in FIGS. 6 and 7, the first and second core plates 54, 56 include first refrigerant openings 74, 76, respectively, the openings 74, 76 aligning throughout the core 12 to form a first refrigerant manifold space 78 of condenser 40, wherein the first refrigerant manifold space 78 is closed at one end by the back plate 14, and open to refrigerant inlet 28 at the opposite end. In some embodiments, the refrigerant manifold space 78 comprises a refrigerant inlet manifold extending throughout the core 12, however, in the present embodiment, the refrigerant manifold space 78 is partitioned, as discussed below, such that the refrigerant will follow a multi-pass flow path through the refrigerant flow passages 58 of the condenser 40. This is further described below.

As shown in FIGS. 6 and 7, the core plates 54, 56 are provided with second refrigerant openings 126, 128, respectively, which are aligned throughout the core 12 so as to form a second refrigerant manifold space 130 of the condenser 40. The second refrigerant manifold space 130 is closed at both ends by the back and front plates 14, 16.

Figure 8:
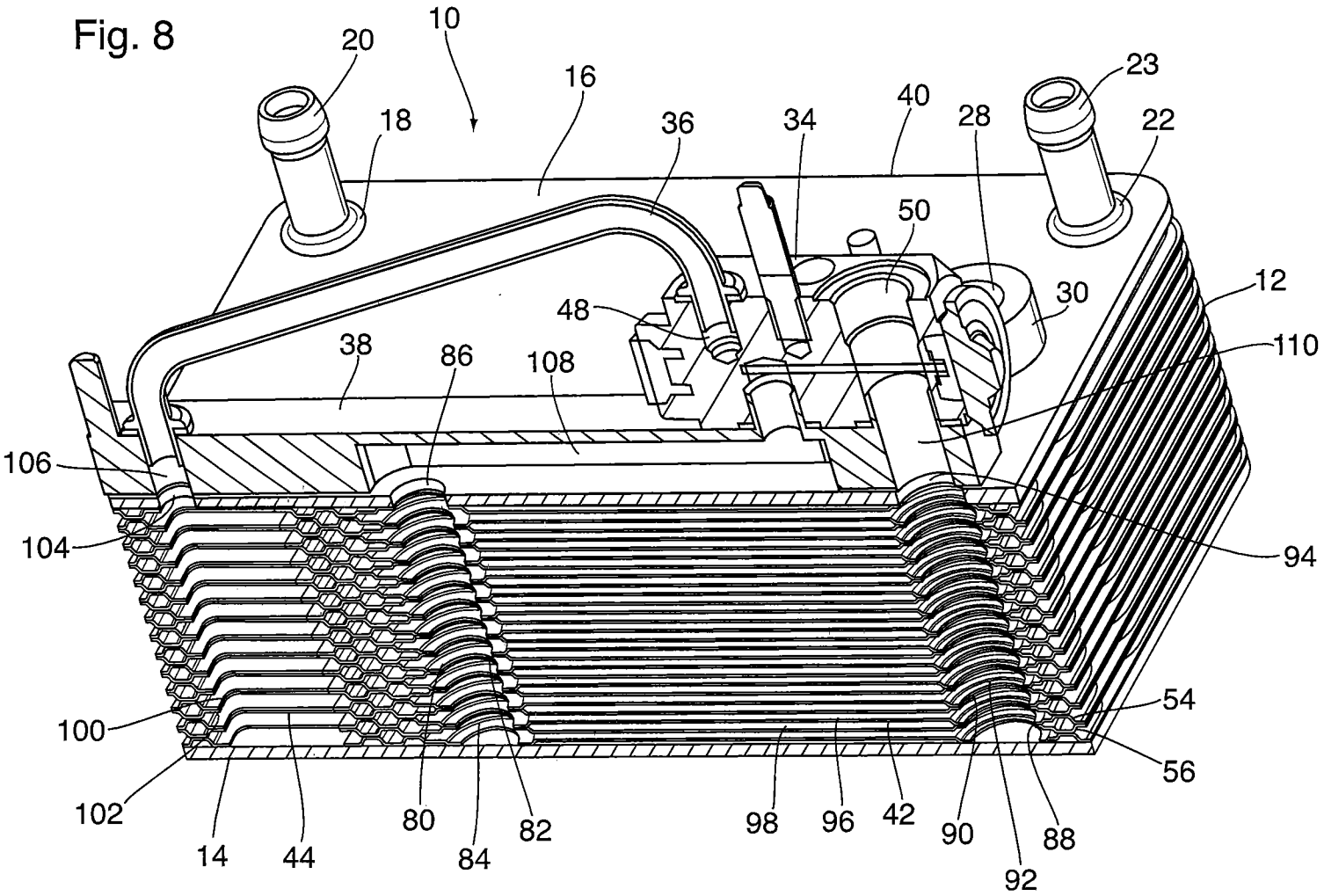
FIG. 8 is a cross-section along line 8-8' of FIG. 2.

FIG. 8 is a cross-section along line 8-8' of FIG. 2. The plane of the cross section of FIG. 8 extends through the evaporator 42 and the refrigerant reservoir 44, and also extends through the thermal expansion valve 34, mounting block 38 and return tube 36.

As can be seen from FIG. 8, the core plates 54, 56 include refrigerant inlet openings 80, 82, respectively, which are aligned throughout the core 12 to form a refrigerant inlet manifold 84 of the evaporator 42, the refrigerant inlet manifold 84 being open to a refrigerant inlet opening 86 in front plate 16, and the other end of refrigerant inlet manifold 84 being closed by the back plate 14.

The core plates 54, 56 are also provided with refrigerant outlet openings 88, 90, respectively, which are aligned throughout the core 12 to form a refrigerant outlet manifold 92 of the evaporator 42, which is open at one end to a refrigerant outlet opening 94 of front plate 16 and closed at the opposite end by back plate 14. Within the evaporator 42, separate passages for flow of a coolant and the refrigerant are provided. In this regard, the core plates 54, 56 define alternating refrigerant flow passages 96 extending from the refrigerant inlet manifold 84 to the refrigerant outlet manifold 92, and coolant flow passages 98 extending between coolant inlet and outlet manifolds, which are described below.

FIG. 8 also shows that the first and second core plates 54, 56 are provided with reservoir openings 100, 102 which are aligned throughout the core 12 to form the refrigerant reservoir 44, which is open to a reservoir outlet opening 104 provided in front plate 16 and is sealed at its opposite end by the back plate 14. In the present embodiment, the reservoir 44 is located in a lower portion of core 12, beside the condenser 40 and below the evaporator 42. However, other configurations are possible, as discussed further below.

As can be seen from FIG. 8, the reservoir outlet opening 104 of front plate 16 is in communication with a bore 106 extending through the mounting block 38, wherein the bore 106 sealingly receives one end of the return tube 36. Thus, pressurized liquid refrigerant flows out of the reservoir 44 and into the return tube 36. A sealed connection between the return tube 36 and the bore 106 of mounting block 38 may be achieved in a number of different ways, for example by brazing, welding, compression, threading, etc. It will be appreciated that the portion of mounting block 38 provided over reservoir outlet opening 104 may be replaced by a simple fitting which sealingly receives one end of return tube 36 and which includes bore 106.

The opposite end of the return tube 36 is sealingly connected to the first port 48 of the thermal expansion valve 34 in any of the above manners. The liquid refrigerant is metered through the first port 48 into an internal refrigerant flow passage 108 of the mounting block 38, flowing from the first port 48 of valve 34 to the refrigerant inlet opening 86 of the front plate 16.

The refrigerant then enters the evaporator's refrigerant inlet manifold 84 and enters the refrigerant flow passages 96 of evaporator 42. As it flows through the flow passages 96, the refrigerant evaporates and removes heat from the coolant flowing through the coolant flow passages 98. The expanded refrigerant is then collected in the refrigerant outlet manifold 92 and exits the core 12 through refrigerant outlet opening 94 and a second bore 110 of the mounting block 38, which aligns with and is in flow communication with the second port 50 of valve 34.

Figure 9:
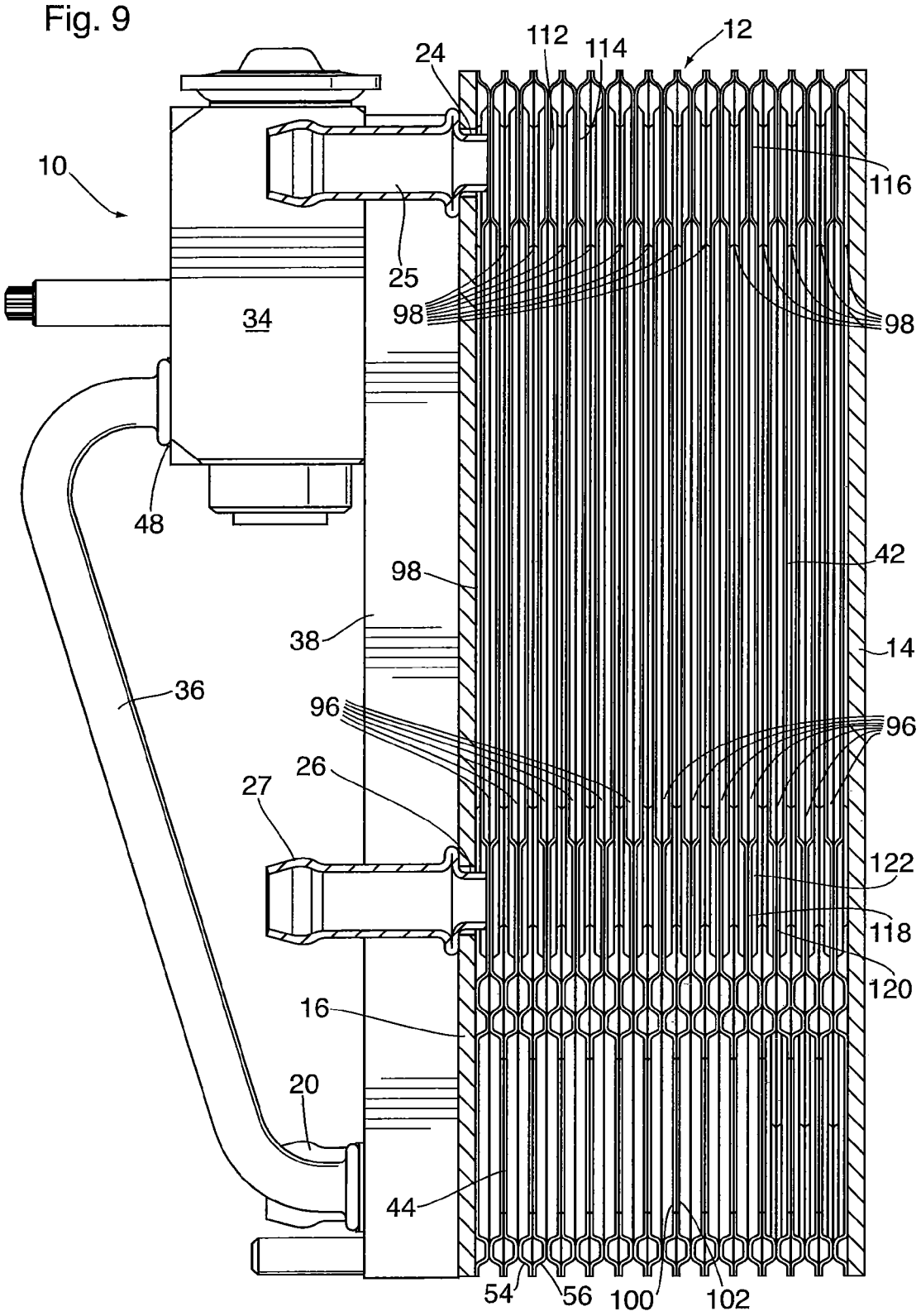
FIG. 9 is a cross-section along line 9-9' of FIG. 2.
Figure 12:
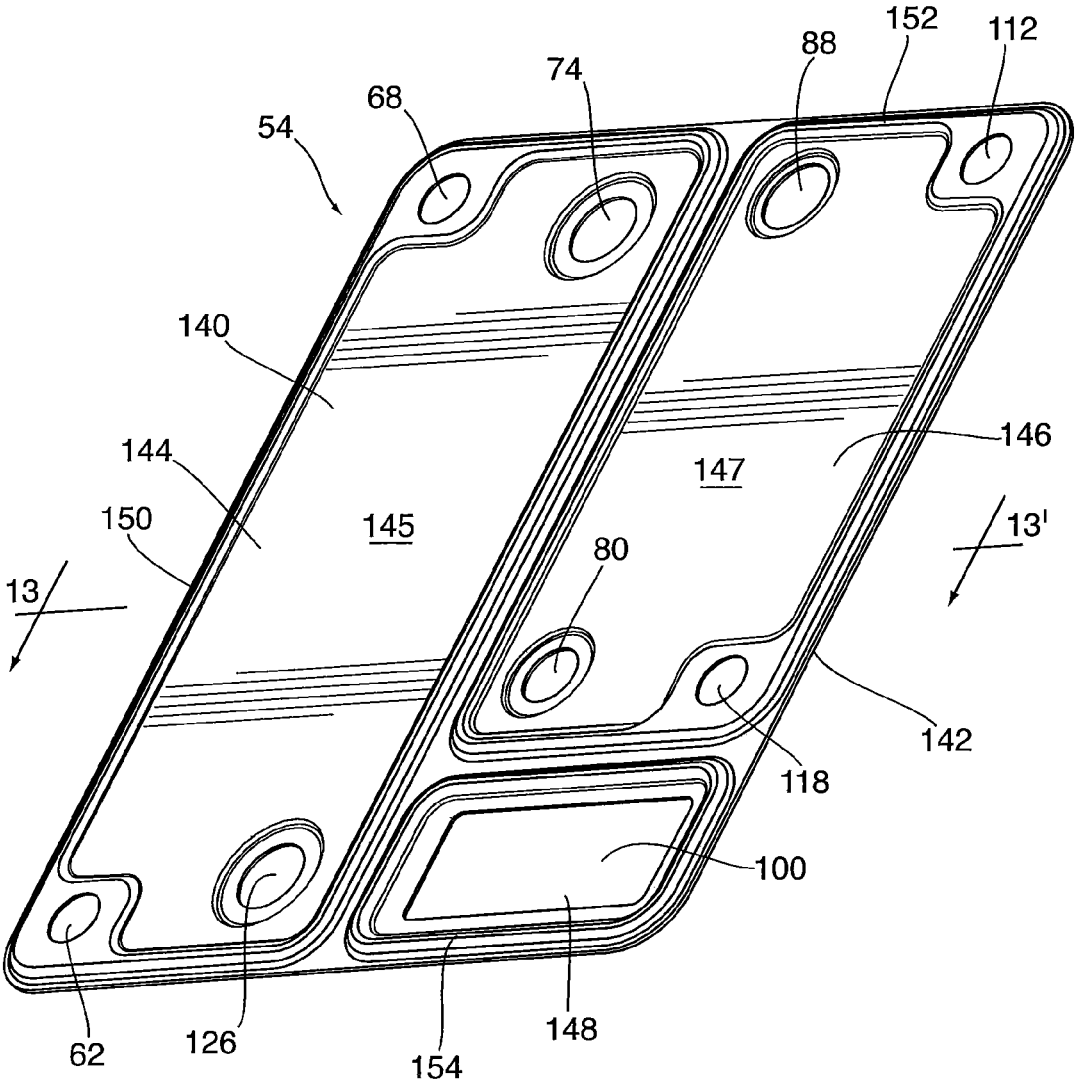
FIG. 12 is an isolated perspective view of a first core plate of the integrated core structure of FIG. 2.
Figure 15:
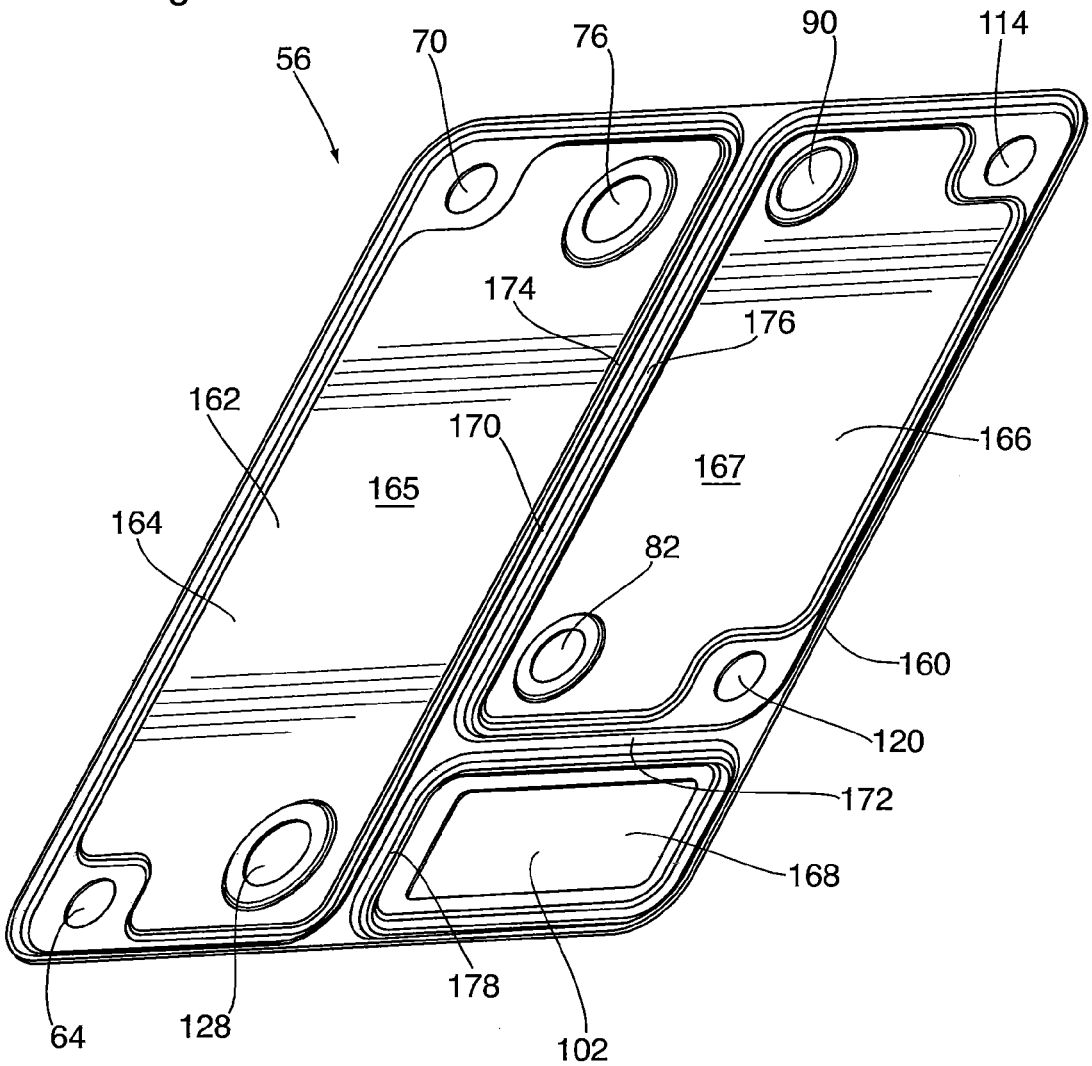
FIG. 15 is an isolated perspective view of a second core plate of the integrated core structure of FIG. 2.

FIG. 9 is a cross section along line 9-9' of FIG. 1. The plane of the cross section of FIG. 9 extends through the evaporator 42 and the refrigerant reservoir 44, and more specifically extends through the evaporator coolant inlet 24 and outlet 26. FIG. 9 shows the alternating refrigerant flow passages 96 and coolant flow passages 98 of the evaporator 42. FIGS. 12 and 15 also show that the first and second core plates 54, 56 are provided with coolant inlet openings 112, 114, respectively. The inlet openings 112, 114 are aligned throughout the core 12 to form a coolant inlet manifold 116 which is open at one end to the evaporator coolant inlet 24 of the front plate 16, and closed at the other end by back plate 14.

Similarly, the first and second core plates 54, 56 are provided with coolant outlet openings 118, 120, respectively, the openings 118, 120 aligning throughout the core 12 to form a coolant outlet manifold 122 of the evaporator 42. The coolant outlet manifold 122 is open to the evaporator coolant outlet 26 in the front plate 16 and the opposite end of the coolant outlet manifold 122 is closed by the back plate 14.

The internal routing of the refrigerant flow through the condenser 40 and into the reservoir 44 is now described below with reference to FIGS. 10 and 11.

Figure 10:
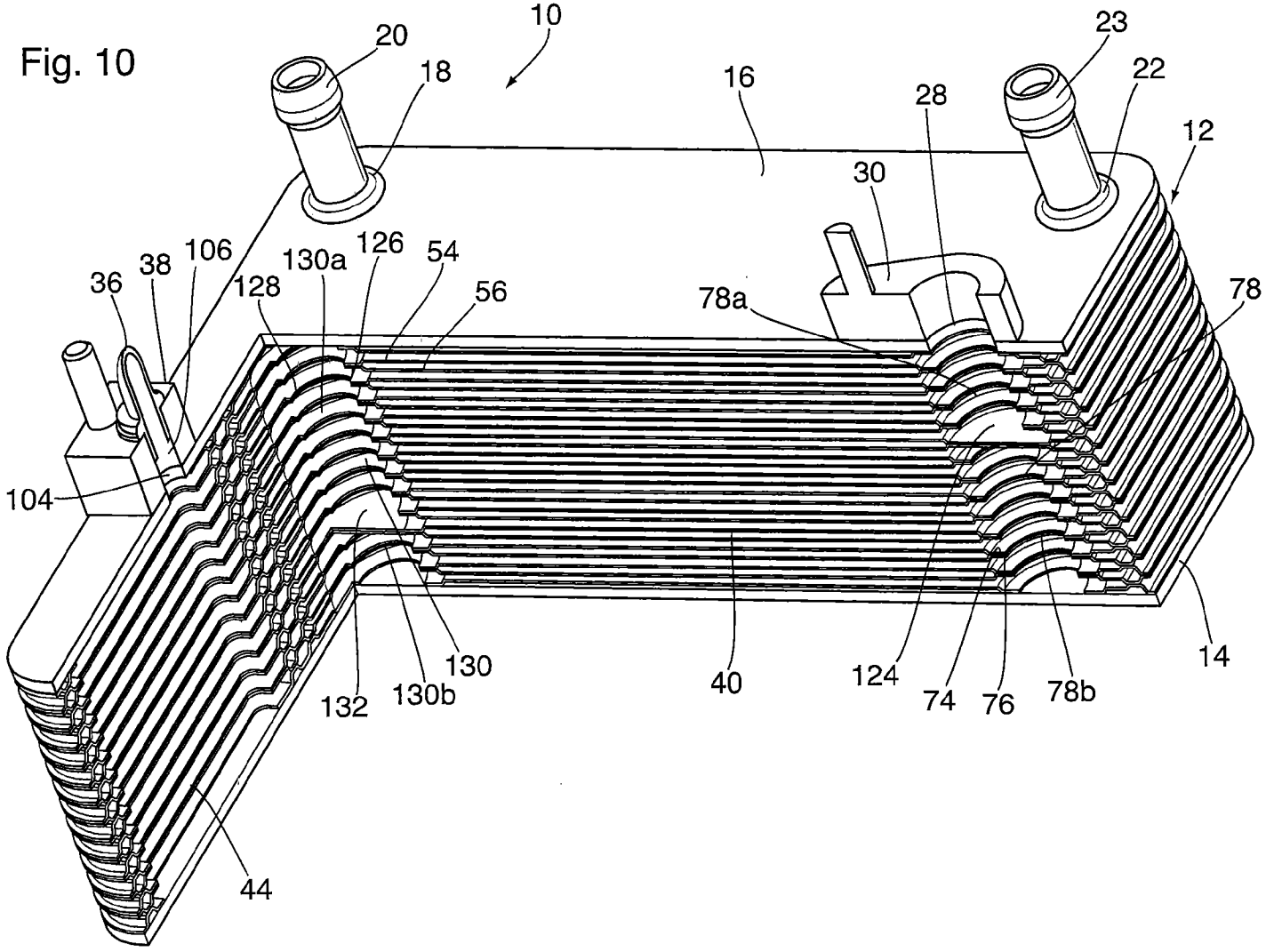
FIG. 10 is a cross-section along line 10-10' of FIG. 1.

FIG. 10 comprises an L-shaped cross-section along line 10-10' of FIG. 1, wherein line 10-10' extends through the first refrigerant manifold space 78 and second refrigerant manifold space 130 of the condenser 40, and also extends transversely through the reservoir 44 and the reservoir outlet opening 104. FIG. 11 provides a transverse cross-sectional view through the bottom portion of condenser 40 and refrigerant reservoir 44.

As described above, the condenser 40 includes a first refrigerant manifold space 78 which is defined by the aligned first refrigerant openings 74, 76 of the core plates 54, 56. Included within the first refrigerant manifold space 78 is a partition 124 which comprises a "blind" refrigerant opening 74 in one of the first core plates 54. As shown in FIG. 10, there are five refrigerant flow passages 58 between the front plate 16 and the partition 124.

The partition 124 divides the first refrigerant manifold space 78 into two portions, labeled **78*a* and 78*b* in the drawings. Portion 78*a*, extending from the refrigerant inlet 28 to the partition 124, comprises a refrigerant inlet manifold of the condenser 40, while the portion 78*b*** comprises a turnaround manifold space, the purpose of which will be explained below.

As mentioned above, and as shown in FIG. 10, the core plates 54, 56 are provided with second refrigerant openings 126, 128, respectively, which are aligned throughout the core 12 so as to form a second refrigerant manifold space 130 of the condenser 40. The second refrigerant manifold space 130 is closed at both ends by the back and front plates 14, 16. Included within the second refrigerant manifold space 130 is a partition 132 (also shown in FIG. 7) which comprises a "blind" refrigerant opening 126 in one of the first core plates 54. As shown in FIG. 10, there are ten refrigerant flow passages 58 between the front plate 16 and the partition 132, and three refrigerant flow passages 58 between partition 132 and the back plate 14.

The partition 132 divides the second refrigerant manifold space 130 into two portions, labeled 130*a* and 130*b* in the drawings. Portion 130*a*, extending from the front plate 16 to the partition 130, comprises a turnaround manifold space, while the portion 130*b* comprises an outlet manifold space of condenser 40, as will be further explained below.

The partition 124 directs the refrigerant received within the refrigerant inlet manifold 78*a* to flow through the first five refrigerant flow passages 58 of the condenser 40 to the turnaround manifold space 130*a* at the opposite end of the condenser 40. This is the first pass through the condenser 40. Once the refrigerant is received in the turnaround manifold space 130*a*, the presence of partition 132 causes the refrigerant to change direction and flow through the second five refrigerant flow passages 58 of the condenser 40 to the turnaround manifold space 78*b* at the opposite end of condenser 40. This is the second pass through the condenser 40. Once the refrigerant is received in the turnaround manifold space 78*b*, the refrigerant is caused to change direction and flow through the last three refrigerant flow passages 58 of the condenser 40 to the refrigerant outlet manifold space 130*b* of condenser 40. This is the third pass through the condenser 40.

It will be appreciated that the number of refrigerant passes through the condenser 40, and the number of refrigerant flow passages 58 making up each pass, will depend upon the specific application, and may vary from those shown in the drawings. As will be appreciated, the number of passes can be increased by increasing the number of partitions, and the number of refrigerant flow passages 58 within each pass can be varied by varying the spacing of the partitions and/or by varying the number of plates 54, 56 in the core 12.

The core plates 54, 56 require modification in order to produce the partitions 124 and 132 described above. This can be accomplished by providing a removable die or punch in the tooling for one or both of the core plates 54, 56. When it is desired to produce core plates having partitions 124, 132, the die can be removed so that the refrigerant opening 74 or 126 will not be punched out. The use of removable dies or punches permits the same die to be used to production of core plates 54, 56 with or without the partitions 124, 132.

Figure 11:
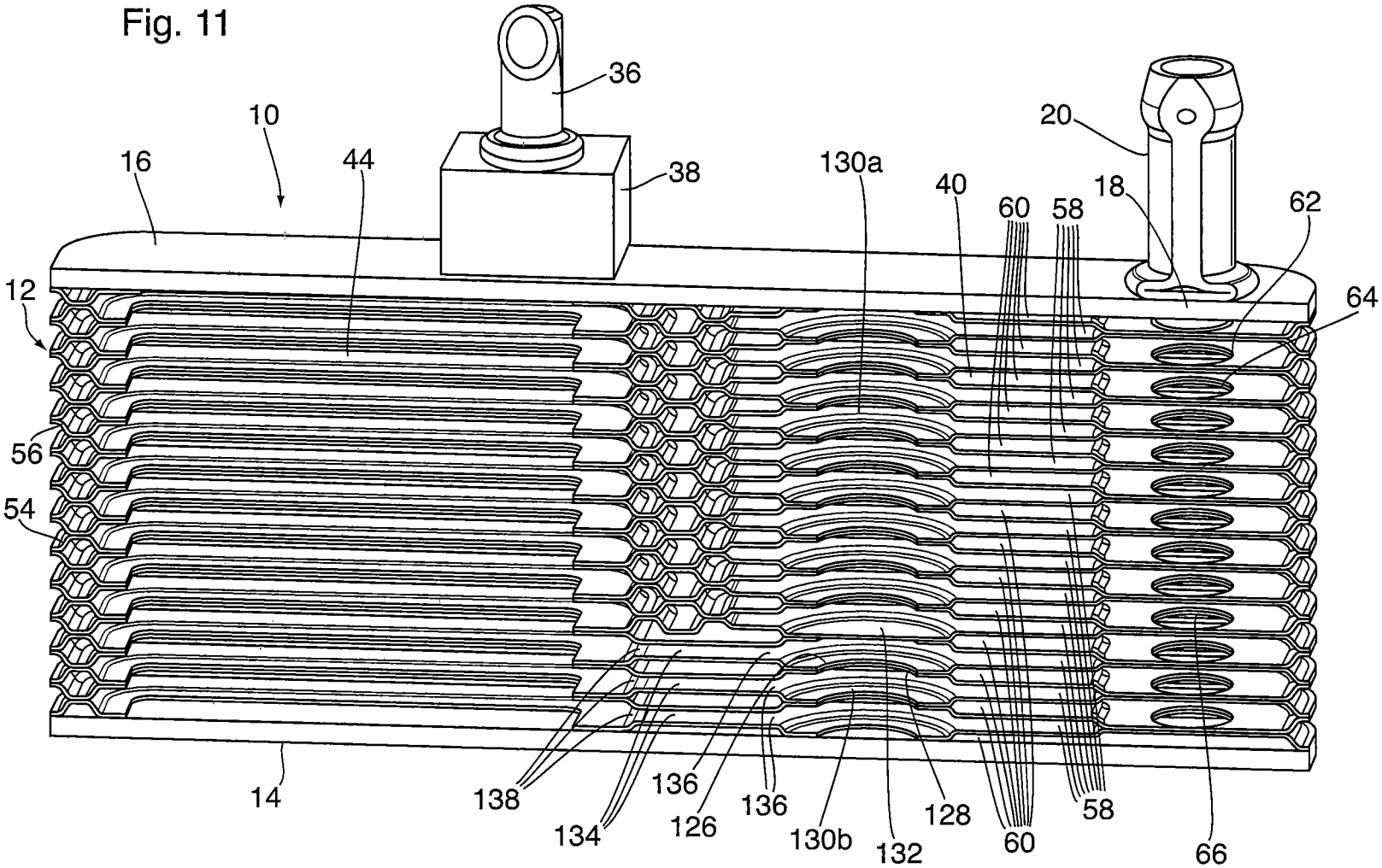
FIG. 11 is a cross-section along line 11-11' of FIG. 2.

As best seen in the transverse cross section of FIG. 11, the first and second core plates 54, 56 defining the three lowermost refrigerant flow passages 58 of the condenser 40 are modified so as to define refrigerant communication passages 134 providing flow communication between the refrigerant outlet manifold space 130*b* and the interior of the refrigerant reservoir 44. These refrigerant communication passages 134 define both a refrigerant outlet 136 of the condenser 40 and a refrigerant inlet 138 of the refrigerant reservoir 44.

Thus, to summarize, the internal routing of refrigerant through the condenser 40, as described above, causes the refrigerant to follow a multi-pass flow path through the condenser 40, wherein the multi-pass flow path consists of three passes through the condenser 40. Furthermore, it can be seen that the condensed refrigerant from the condenser 40 passes directly to a reservoir 44 which is integrated into the core 12, without flowing through any external conduits, thereby eliminating fluid connections and providing a more leak-resistant, compact structure. Also, the elimination of external refrigerant connections helps to minimize the volume of refrigerant needed to charge the system.

As with the partitions 124, 132, one or both of the core plates 54, 56 require modification in order to produce plates which have or do not have a refrigerant communication passage 134. This modification of core plates 54, 56 can also be accomplished by providing removable dies in the tooling for the core plates 54, 56, wherein these removable dies stamp the portions of the plates 54, 56 in the region of the refrigerant communication passage 134. As will be appreciated, the use of removable dies to accomplish this modification can result in reduced tooling costs.

As mentioned above, the provision of refrigerant communication passages 134 requires some modification of the first and/or second core plates 54, 56 in the core 12. The configurations of the plates are now described below with reference to FIGS. 12 to 16.

FIG. 12 illustrates a first core plate 54 having a refrigerant side 140 and an opposite coolant side 142, with the refrigerant side 140 facing up in FIG. 12. As can be seen from FIG. 12, the refrigerant side 140 of first core plate 54 is provided with a plurality of raised partitions along which the first core plate 54 is sealingly joined to an adjacent second core plate 56. These partitions divide the first core plate 54 into a condenser section 144, an evaporator section 146 and a reservoir section 148.

The condenser section 144 comprises a condenser wall 145 separating the refrigerant side 140 and the coolant side 142 of first plate 54. In the assembled core, the condenser sections 144 are aligned throughout the core 12, and the condenser wall 145 separates the refrigerant flow passages 58 of the condenser 40 from the coolant flow passages 60 of the condenser 40.

Similarly, the evaporator section 146 comprises an evaporator wall 147 separating the refrigerant side 140 and the coolant side 142 of first plate 54. In the assembled core, the evaporator sections 146 are aligned throughout the core 12, and the evaporator wall 147 separates the refrigerant flow passages 96 of the evaporator 42 from the coolant flow passages 98 of the evaporator 42.

The raised partitions include an upstanding condenser partition 150 which completely surrounds the condenser section 144 and prevents flow of refrigerant along the refrigerant side 140 of plate 54 from the condenser section 144 to the evaporator section 146 and/or the reservoir section 148. The condenser partition 150 encloses coolant openings 62, 68 and refrigerant openings 74, 126.

Further, an evaporator partition 152 surrounds the evaporator section 146 of first core plate 54, including the refrigerant openings 80, 88 and the coolant openings 112 and 118. A reservoir partition 154 surrounds the reservoir opening 100.

Figure 13:
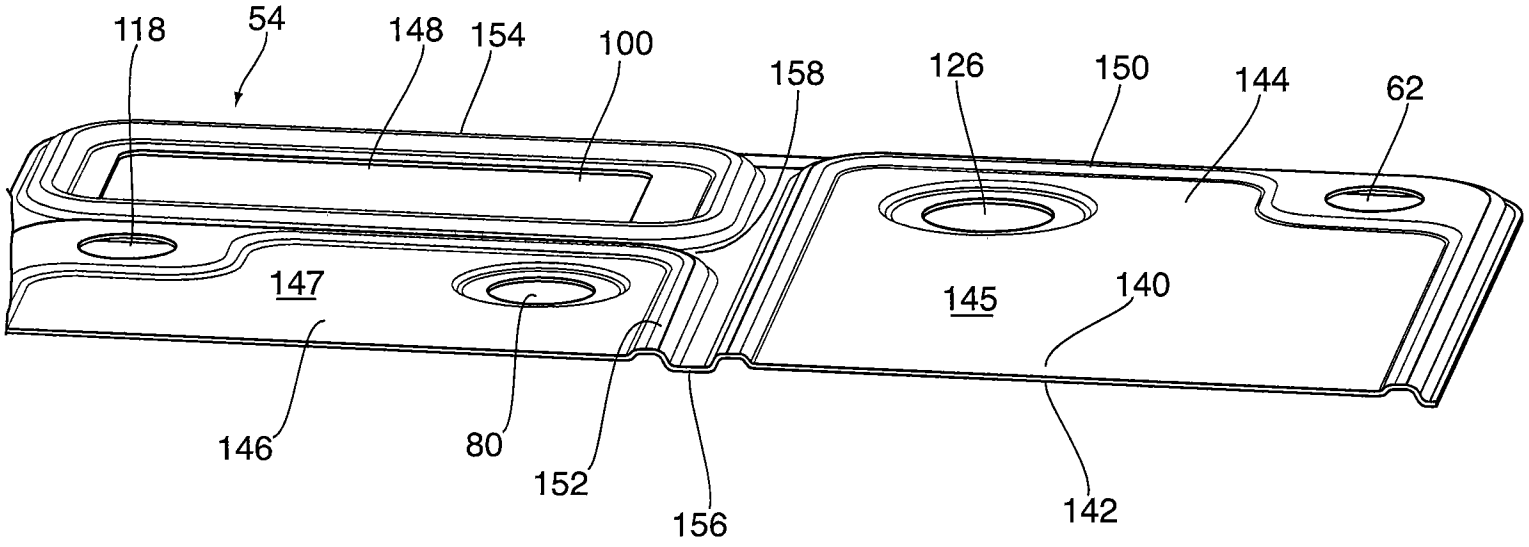
FIG. 13 is a cross-section along line 13-13' of FIG. 12.

In the cross-section of FIG. 13, it can be seen that the opposite, coolant side 142 of first core plate 54 comprises a plurality of partitions which similarly separate the condenser section 144, evaporator section 146 and reservoir section 148 from one another. In this regard, an elongate condenser partition 156 extends throughout the length of first core plate 54 and separates the condenser section 144 from the evaporator section 146 and the reservoir section 148, and an evaporator partition 158 separates the evaporator section 146 from the reservoir section 148.

The plate configuration shown in FIGS. 12 and 13 does not include a refrigerant communication passage 134.

Figure 14:
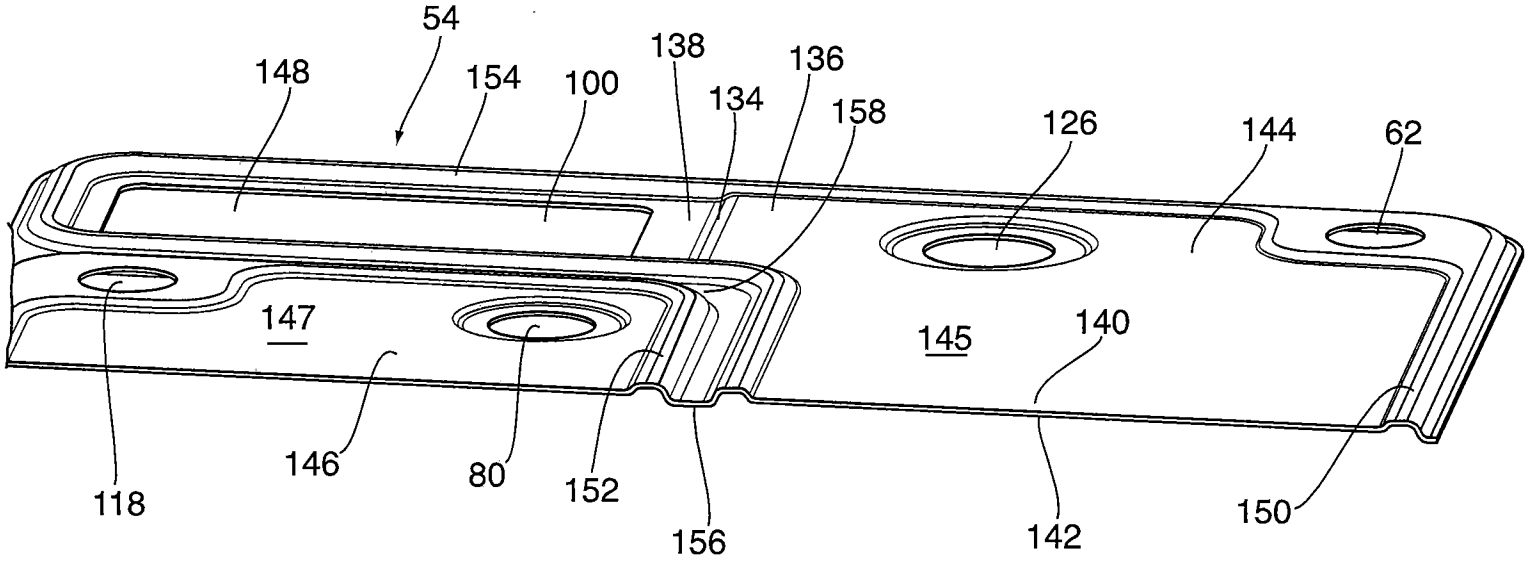
FIG. 14 is a cross-section, similar to that of FIG. 13, showing a modified version of the first core plate.

FIG. 14 shows a variant of first plate 54, wherein the partitions 150 and 154 surrounding the condenser section 144 and reservoir section 148 respectively, on the refrigerant side 140 of first plate 54, are interrupted to provide the refrigerant communication passage 134, so as to permit refrigerant to flow from the outlet manifold space 130*b* of condenser 40 to the reservoir 44.

Figure 16:
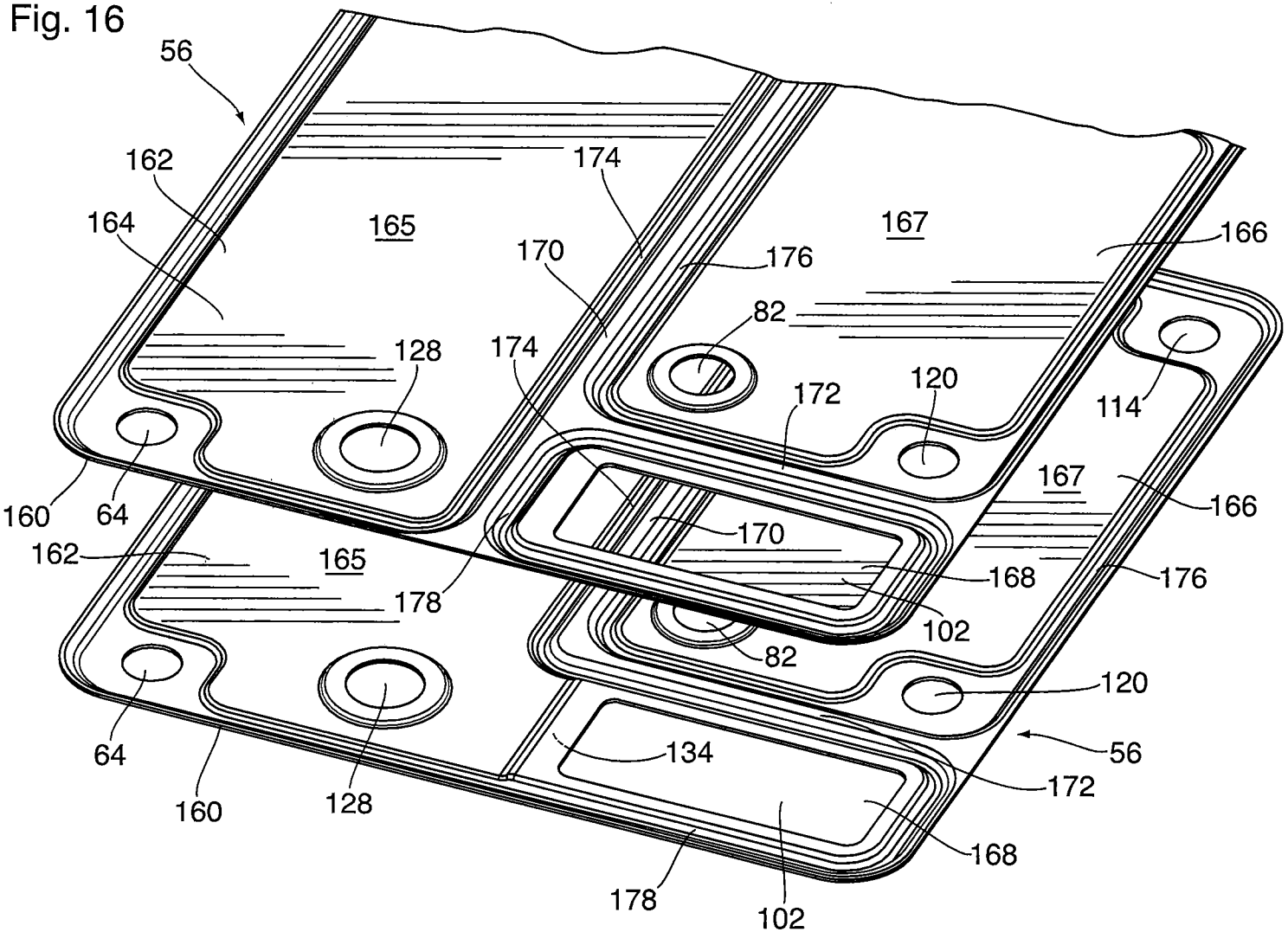
FIG. 16 is a perspective view of a portion of the second core plate of FIG. 15, shown beside a modified version of the second core plate.

FIGS. 15 and 16 similarly illustrate the configuration of the second plate 56, having a refrigerant side 160 and an opposite coolant side 162, with the coolant side facing up in these drawings. As can be seen from FIG. 15, the coolant side 162 of second core plate 56 is provided with a plurality of raised partitions along which the second core plate 56 is sealingly joined to an adjacent first core plate 54. These partitions divide the second core plate 56 into a condenser section 164 having a condenser wall 165, an evaporator section 166 having an evaporator wall 167, and a reservoir section 168.

The condenser wall 165 separates the refrigerant side 160 and the coolant side 162 of second plate 56. In the assembled core, the condenser sections 164 are aligned with one another and with condenser sections 144 of the first core plate 54 throughout the core 12, and the condenser walls 165 separate the refrigerant flow passages 58 of the condenser 40 from the coolant flow passages 60 of the condenser 40.

Similarly, the evaporator wall 167 separates the refrigerant side 160 and the coolant side 162 of second plate 56. In the assembled core 12, the evaporator sections 166 are aligned with one another and with evaporator sections 146 of the first core plate 54 throughout the core 12, and the evaporator walls 167 separate the refrigerant flow passages 96 of the evaporator 42 from the coolant flow passages 98 of the evaporator 42.

The raised partitions on the coolant side 162 of second core plate 56 include an elongate condenser partition 170 extending throughout the length of second core plate 56 and separating the condenser section 164 from the evaporator section 166 and the reservoir section 168, and an evaporator partition 172 separating the evaporator section 166 from the reservoir section 168.

The raised partitions on the refrigerant side 160 of second core plate 56 include an upstanding condenser partition 174 which completely surrounds the condenser section 164 and prevents flow of refrigerant along the refrigerant side 160 of plate 56 from the condenser section 164 to the evaporator section 166 and/or the reservoir section 168. The condenser partition 174 encloses coolant openings 64, 70 and refrigerant openings 76, 128.

Further, an evaporator partition 176 surrounds the evaporator section 166 of second core plate 56, including the refrigerant openings 82, 90 and the coolant openings 114 and 120. A reservoir partition 178 surrounds the reservoir opening 102.

The second core plate 56 shown in FIG. 15 and the upper second core plate 56 of FIG. 16 include raised partitions which prevent refrigerant flow between the condenser 40 and the reservoir 44. However, the bottom plate 56 of FIG. 16 is a variant of second core plate 56 in which the partitions 174 and 178 surrounding the condenser section 164 and reservoir section 168 respectively, on the refrigerant side 160 of second core plate 56, are interrupted to provide the refrigerant communication passage 134, so as to permit refrigerant to flow from the outlet manifold space 130*b* of condenser 40 to the reservoir 44.

In order to improve efficiency of the system 10, it will be appreciated that thermal breaks may be provided between the condenser 40 and the evaporator 42, so as to minimize heat transfer between these two components. These thermal breaks can take the form of apertures such as small holes or slots provided in the portions of the core plates 54, 56 located between the condenser 40 and evaporator 42. The inclusion of thermal breaks may require the core plates 54, 56 to be widened somewhat.

Although not shown in the drawings, it will be appreciated that the refrigerant and coolant flow passages of the condenser 40 and evaporator 42 may be provided with turbulence-enhancing features in order to provide increased turbulence and surface area for heat transfer, and to provide structural support for the core 12. These turbulence-enhancing features may take the form of ribs and/or dimples which are formed in the walls of the core plates 54 and/or 56 (e.g. in the condenser walls 145, 165 and/or evaporator walls 165, 167). Alternatively, the turbulence-enhancing features may take the form of turbulence-enhancing inserts such as corrugated fins or turbulizers. As used herein, the terms "fin" and "turbulizer" are intended to refer to corrugated turbulence-enhancing inserts having a plurality of axially-extending ridges or crests connected by sidewalls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and examples of such turbulizers are described in U.S. Pat. No. Re. 35,890 (So) and U.S. Pat. No. 6,273,183 (So et al.). The patents to So and So et al. are incorporated herein by reference in their entireties.

A refrigeration system 200 according to a second embodiment is now described with reference to FIGS. 17 to 28. Refrigeration system 200 includes a number of elements which are either similar or identical to those of refrigeration system 10 described above. In the following description like elements are identified with like reference numerals, and the above descriptions of these like elements in system 10 applies to the elements of system 200, unless otherwise stated below. One significant difference between refrigeration system 200 and refrigeration system 10 is that the plates of refrigeration system 200 are constructed to eliminate the need for a mounting block 38.

Figure 17:
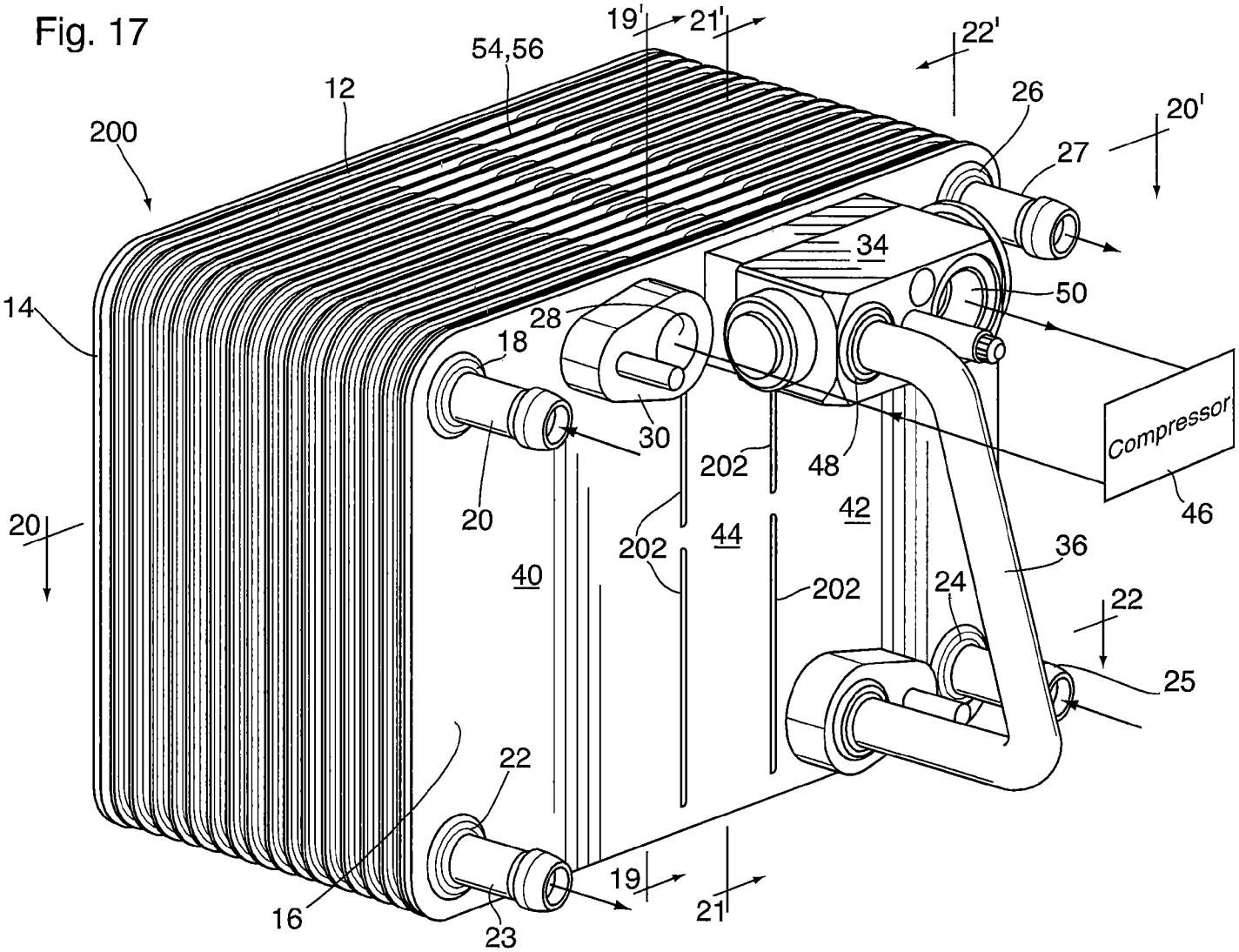
FIG. 17 is a front perspective view of refrigeration system according to a second embodiment described herein.
Figure 18:
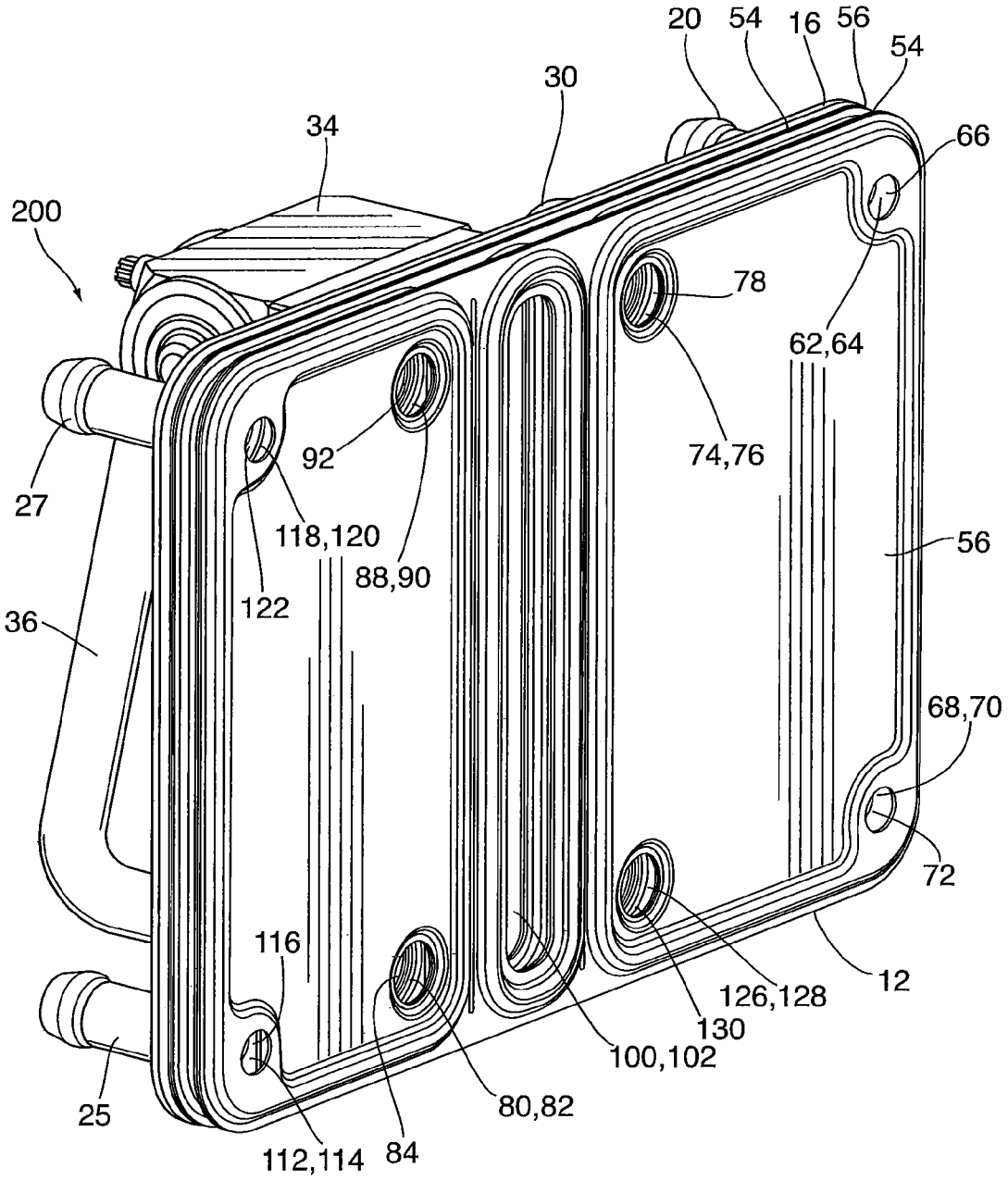
FIG. 18 is a partial rear perspective view of the integrated core structure of the refrigeration system of FIG. 17.

FIG. 17 shows the external appearance of the refrigeration system 200 in the approximate orientation in which it will be installed. The refrigeration system 200 includes an integrated core structure 12 (referred to herein as "core 12") and a compressor 46. The core 12 comprises a stack of core plates 54, 56 sandwiched between a back plate 14 and a front plate 16. The back plate 14 is free of perforations, and the front plate 16 is provided with a plurality of refrigerant and coolant connections.

The core 12 of refrigeration system 200 integrates a number of components, including a condenser 40, an evaporator 42 and a refrigerant reservoir 44. As shown in FIG. 17, the front plate 16 includes two rows of slots 202 as thermal breaks. The condenser 40 comprises the portion of core 12 to the left of slots 202, the evaporator 42 comprises the portion of core 12 to the right of slots 202, and the refrigerant reservoir 44 comprises the portion of core 12 located between the two rows of slots 202.

Core 12 of refrigeration system 200 includes a condenser coolant inlet 18 ("first coolant inlet") and a condenser coolant outlet 22 ("first coolant outlet") in the front plate 16, in the portion of core 12 defining the condenser 40. A condenser coolant inlet fitting 20 is sealingly attached to the condenser coolant inlet 18, and a condenser coolant outlet fitting 23 is sealingly attached to the condenser coolant outlet 22. The condenser coolant inlet 18 is close to the top of core 12 and condenser 40, while the condenser coolant outlet 22 is close to the bottom of core 12 and condenser 40. Therefore, the coolant flows downwardly from the top to the bottom of condenser 40, but the direction of coolant flow may instead be from bottom to top as in the first embodiment.

Core 12 of refrigeration system 200 includes an evaporator coolant inlet 24 ("second coolant inlet") and an evaporator coolant outlet 26 ("second coolant outlet") in the front plate 16, in the portion of core 12 defining the evaporator 42. An evaporator coolant inlet fitting 25 is sealingly attached to the evaporator coolant inlet 24, and an evaporator coolant outlet fitting 27 is sealingly attached to the evaporator coolant outlet 26. The evaporator coolant inlet 24 is close to the bottom of evaporator 42 and core 12. The evaporator coolant outlet 26 is shown as being close to the top of evaporator 42 and core 12, so that the coolant will flow upwardly through the evaporator 42. However, the coolant may instead flow through evaporator 42 from the top to the bottom, as in the first embodiment.

The core 12 of refrigeration system 200 further comprises a refrigerant inlet 28 in the front plate 16, in the portion of core 12 defining condenser 40. A refrigerant inlet fitting 30 is sealingly attached to the refrigerant inlet 28. In use, a pressurized gaseous refrigerant from the outlet of compressor 46 is fed to the condenser 40 through the refrigerant inlet fitting 30 and inlet 28. As the gaseous refrigerant flows through the condenser 40, it is cooled and condensed by heat transfer to the coolant, and therefore the coolant exiting the condenser through outlet 22 is at a higher temperature than the coolant entering the condenser through inlet 18.

The refrigerant outlet from condenser 40 to refrigerant reservoir 44 is contained within the core 12, and is not visible in FIG. 17.

The core 12 of refrigeration system 200 also includes a thermal expansion valve 34 for metering refrigerant into the evaporator 42, and a return tube 36 for conveying the refrigerant from the refrigerant reservoir 44 to the evaporator 42. The thermal expansion valve 34 has a first port 48 and a second port 50, which are side-by-side in the second embodiment. Valve 34 meters the flow of refrigerant through first port 48 based on conditions monitored at the second port 50. In this regard, pressurized liquid refrigerant from refrigerant reservoir 44 flows to the first port 48 of valve 34 through a reservoir outlet opening 104 (FIG. 23) provided in the upper end of front plate 16. From the first port 48 of valve 34, the refrigerant enters the return tube 36, which delivers the refrigerant to a refrigerant inlet opening 86 (FIG. 23) at the lower end of evaporator 42. The refrigerant evaporates (i.e. boils) as it passes upwardly through the evaporator 42, thereby extracting heat from the coolant circulating through evaporator 42. The gaseous refrigerant exits the core 12 through a refrigerant outlet opening 94 (FIG. 23) which communicates with the second port 50 of the thermal expansion valve 34. The refrigerant exiting the second port 50 then flows to the inlet of compressor 46.

The core 12 and fittings 20, 23, 25, 27 and 30 may be comprised of a brazeable metal such as aluminum and/or an aluminum alloy, and these components may all be assembled in a single brazing operation in a brazing furnace.

Core 12 is made up of first core plates 54 and second core plates 56, and defines alternating refrigerant flow passages 58 and coolant flow passages 60 within the condenser 40, and defines alternating refrigerant flow passages 96 and coolant flow passages 98 within the evaporator 42. In the present embodiment the first and second core plates 54, 56 are mirror images of one another.

The first and second core plates 54, 56 have coolant inlet openings 62, 64, respectively, which align throughout the core 12 to form a coolant inlet manifold 66 of condenser 40. Similarly, the first and second core plates 54, 56 have coolant outlet openings 68, 70, respectively, which align throughout the core 12 to form a coolant outlet manifold 72 of condenser 40. The coolant inlet and outlet manifolds 66, 72 are each closed at one end by back plate 14, and are open at the other end to the respective condenser coolant inlet and outlet openings 18, 22. The coolant manifolds 66, 72 of condenser 40 are in flow communication with one another through the coolant flow passages 60 of condenser 40. Portions of coolant manifolds 66, 72 are visible in the rear view of FIG. 18, and the coolant inlet manifold 66 is also visible in the cross-section of FIG. 20.

The core plates 54, 56 include first refrigerant openings 74, 76, respectively, which align throughout the core 12 to form a first refrigerant manifold space 78 of condenser 40, which is closed at one end by the back plate 14, and open to refrigerant inlet 28 at the opposite end. The refrigerant manifold space 78 is partitioned, as discussed below, to cause the refrigerant to follow a multi-pass flow path. Core plates 54, 56 also have second refrigerant openings 126, 128, respectively, which are aligned throughout the core 12 to form a second refrigerant manifold space 130 of condenser 40. The second refrigerant manifold space 130 is closed at both ends by the back and front plates 14, 16. The refrigerant manifold spaces 78, 130 are in flow communication with one another through the refrigerant flow passages 58 of condenser 40. Manifold spaces 78 and/or 130 are best seen in the cross-sections of FIGS. 19 and 20.

The core plates 54, 56 include coolant inlet openings 112, 114, respectively, the inlet openings 112, 114 being aligned throughout the core 12 to form a coolant inlet manifold 116 of evaporator. The coolant inlet manifold 116 is open at one end to the evaporator coolant inlet 24 of the front plate 16, and closed at the other end by back plate 14. The core plates 54, 56 are also provided with coolant outlet openings 118, 120, respectively, the openings 118, 120 aligning throughout the core 12 to form a coolant outlet manifold 122 of evaporator 42. The coolant outlet manifold 122 is open to the evaporator coolant outlet 26 in the front plate 16 and the opposite end of the coolant outlet manifold 122 is closed by the back plate 14. The coolant manifolds 116, 122 of evaporator 42 are in flow communication with one another through the coolant flow passages 98 of evaporator 42.

Core plates 54, 56 have refrigerant inlet openings 80, 82, respectively, which are aligned throughout the core 12 to form a refrigerant inlet manifold 84 of evaporator 42, at the lower end of evaporator 42. The refrigerant inlet manifold 84 is open to refrigerant inlet opening 86 in front plate 16, and the other end of refrigerant inlet manifold 84 is closed by the back plate 14. Core plates 54, 56 also have refrigerant outlet openings 88, 90, respectively, which are aligned throughout the core 12 to form a refrigerant outlet manifold 92 of evaporator 42, at the upper end of evaporator 42. The refrigerant outlet manifold 92 is open at one end to refrigerant outlet opening 94 of front plate 16 and closed at the opposite end by back plate 14. The refrigerant manifolds 84, 92 are in flow communication with one another through the refrigerant flow passages 96 of evaporator 42.

Figure 20:
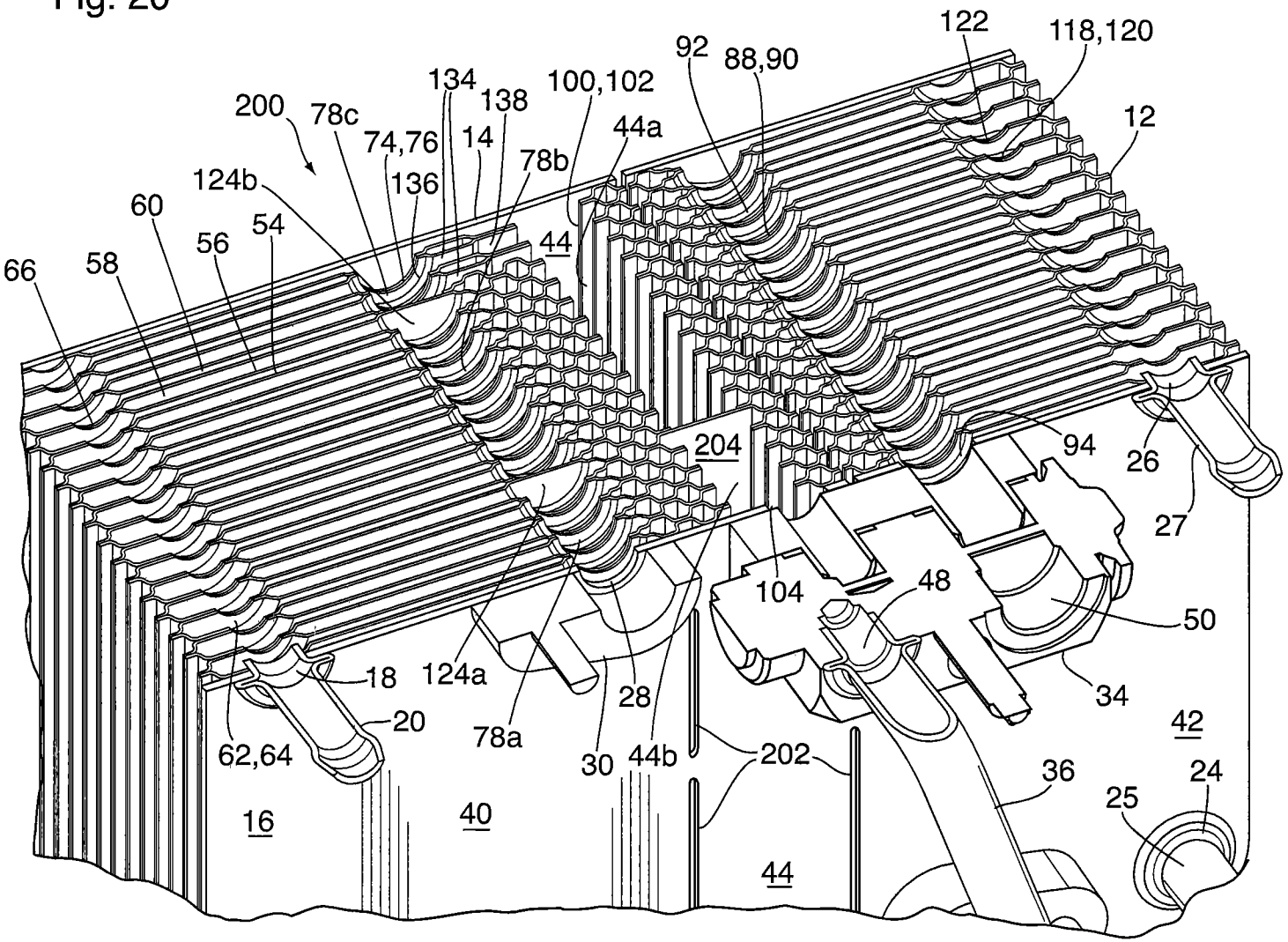
FIG. 20 is a cross-section along line 20-20' of FIG. 17.
Figure 21:
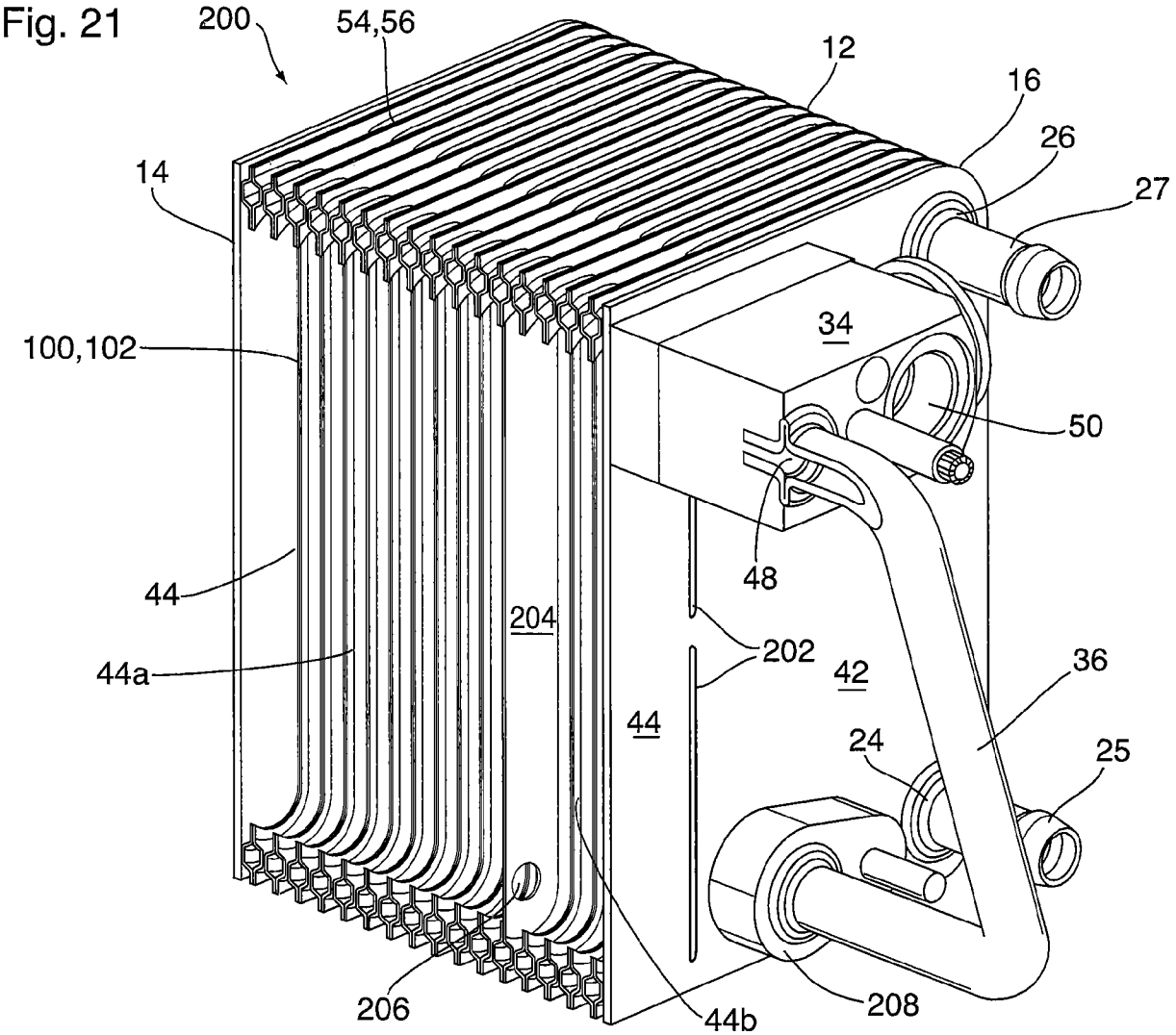
FIG. 21 is a cross-section along line 21-21' of FIG. 17.
Figure 22:
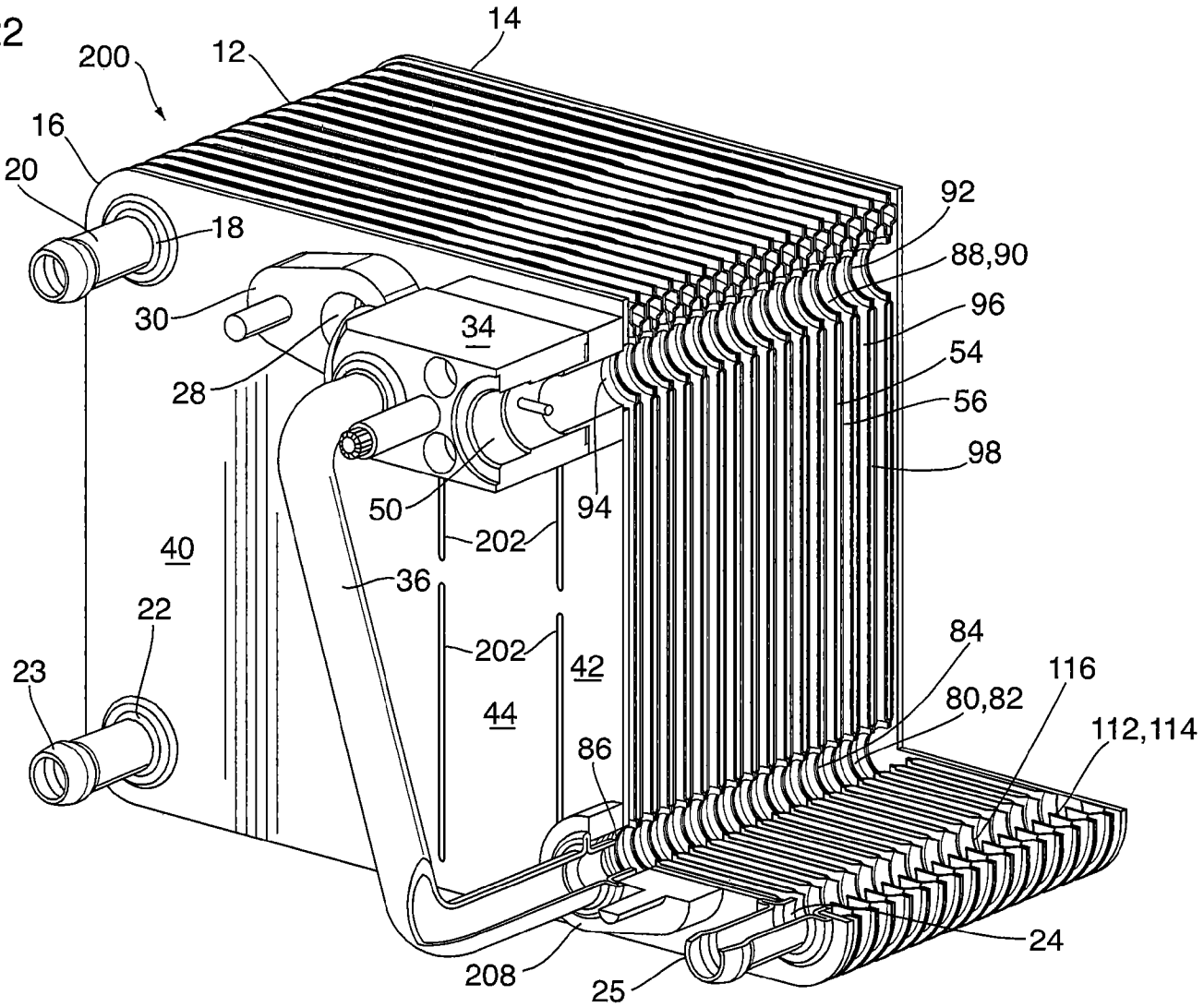
FIG. 22 is a cross-section along line 22-22' of FIG. 17.

The core plates 54, 56 are also provided with reservoir openings 100, 102 which are aligned throughout the core 12 to form refrigerant reservoir 44, which is open to a reservoir outlet opening 104 provided in front plate 16, at an upper end thereof, and is sealed at its opposite end by back plate 14. The valve 34 is attached to front plate 16 with its first port 48 in flow communication with the reservoir outlet opening 104, as shown in FIG. 20.

The refrigerant reservoir 44 of core 12 is provided with a partition 204 which is located intermediate the back plate 14 and front plate 16, and divides the refrigerant reservoir 44 into two portions, labeled 44*a* and 44*b* in the drawings. The partition 204 has one or more openings at its lower end to permit flow communication between the two portions 44*a*, 44*b* of refrigerant reservoir 44. In the present embodiment, one such opening 206 is provided in partition 204.

The first port 48 of valve 34 sealingly receives the upper end of the return tube 36, and the lower end of return tube 36 is sealingly connected to refrigerant inlet opening 86 of the front plate 16, for example through a refrigerant inlet fitting 208. Therefore, the return tube 36 delivers the liquid refrigerant from the reservoir outlet opening 104 at the upper end of the core 12 to the refrigerant inlet opening 86 of evaporator 42, at the lower end of core 12. From the opening 86, the refrigerant enters the evaporator's refrigerant inlet manifold 84 and the refrigerant flow passages 96 of evaporator 42. As it flows upwardly through the flow passages 96, the refrigerant evaporates (i.e. boils) and extracts heat from the coolant flowing through the coolant flow passages 98. The expanded refrigerant is then collected in the refrigerant outlet manifold 92 and exits the core 12 through refrigerant outlet opening 94, which aligns with and is in flow communication with the second port 50 of valve 34.

The internal routing of the refrigerant flow through the core 12 of refrigeration system 200 is now described in more detail with reference to FIGS. 17 to 28.

Figure 23:
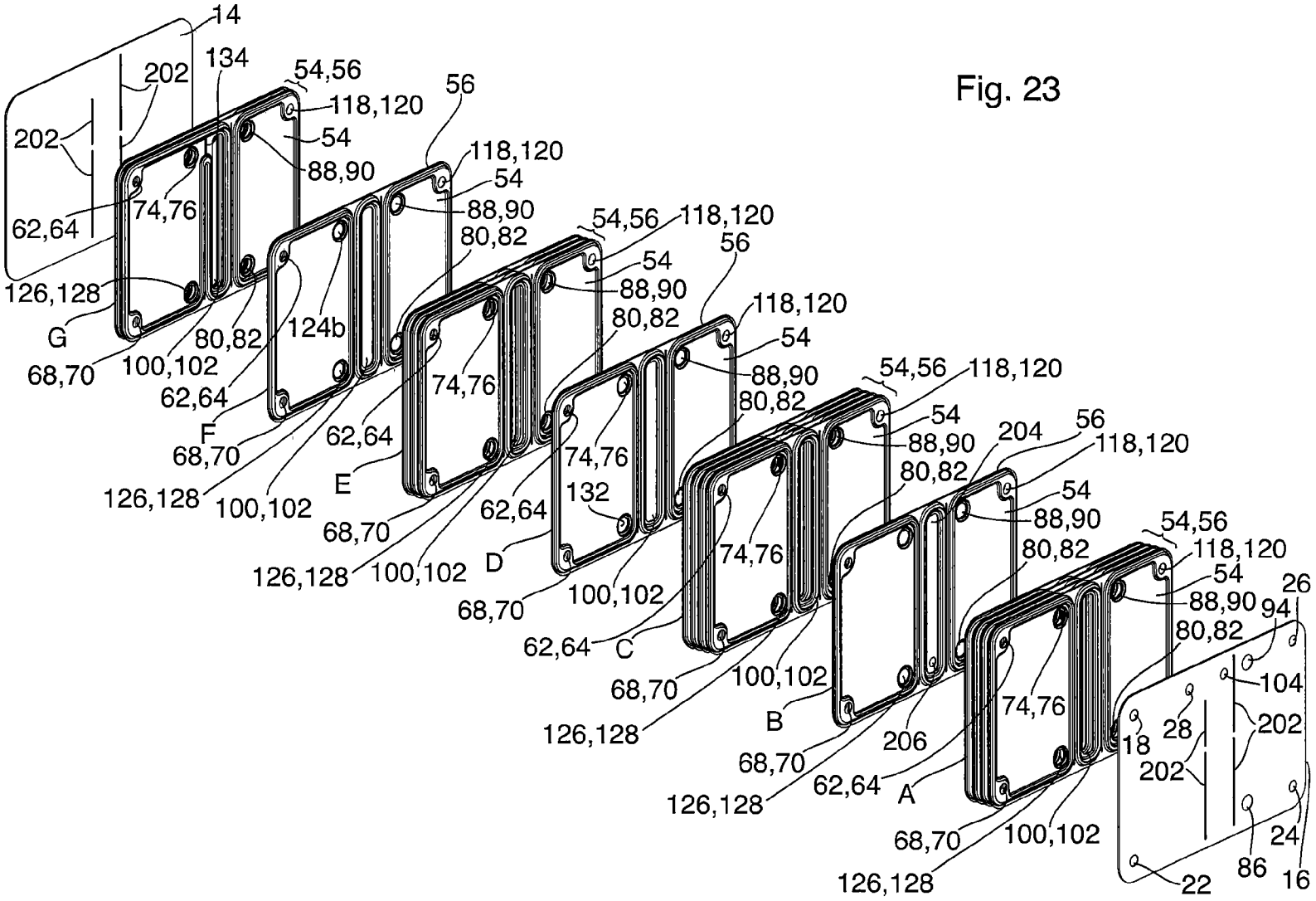
FIG. 23 is an exploded perspective view of the plates making up the integrated core structure of the refrigeration system of FIG. 17.
Figure 24:
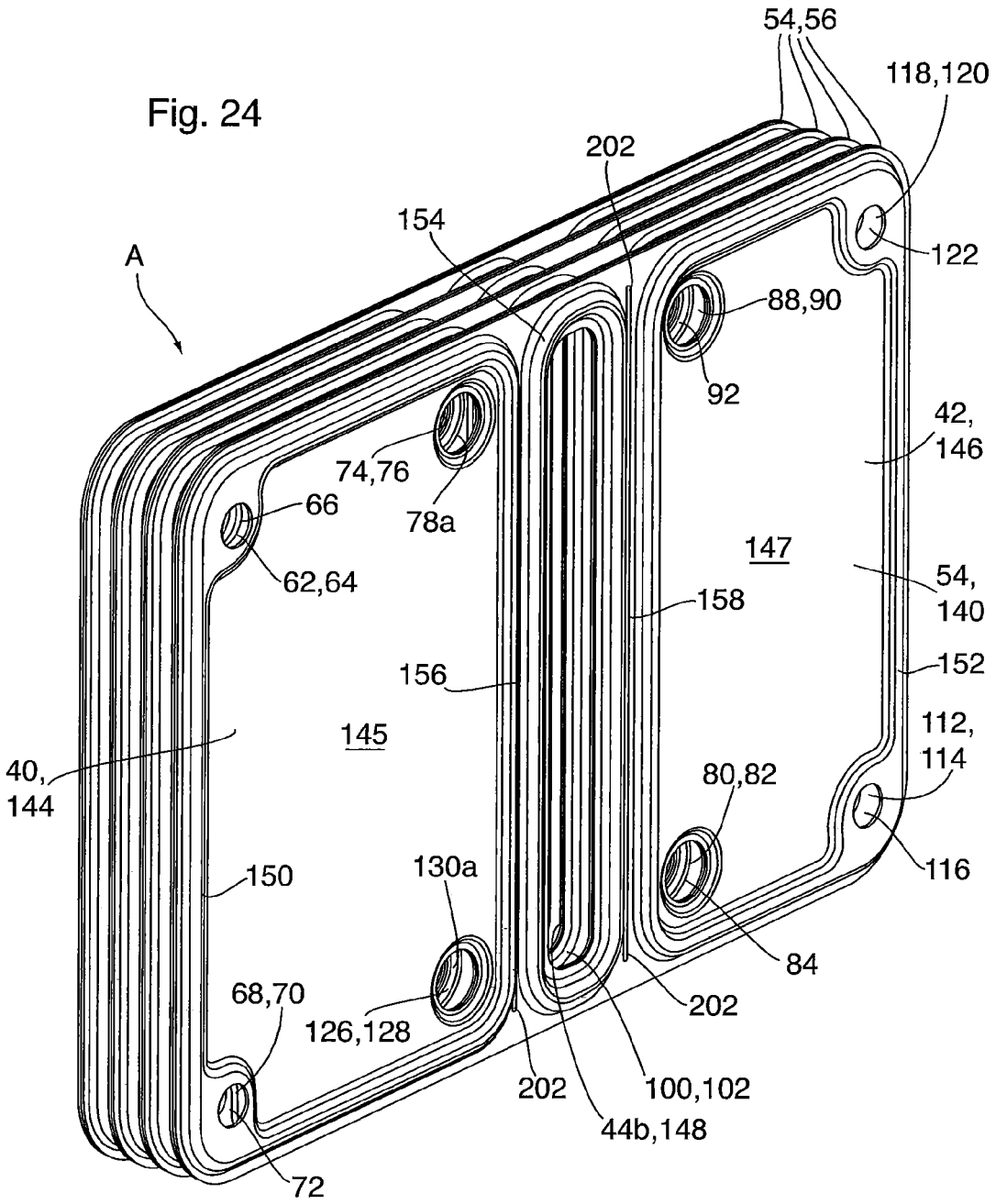
FIG. 24 is a close-up view of one embodiment of a plate pair making up the integrated core structure of the refrigeration system of FIG. 17.
Figure 25:
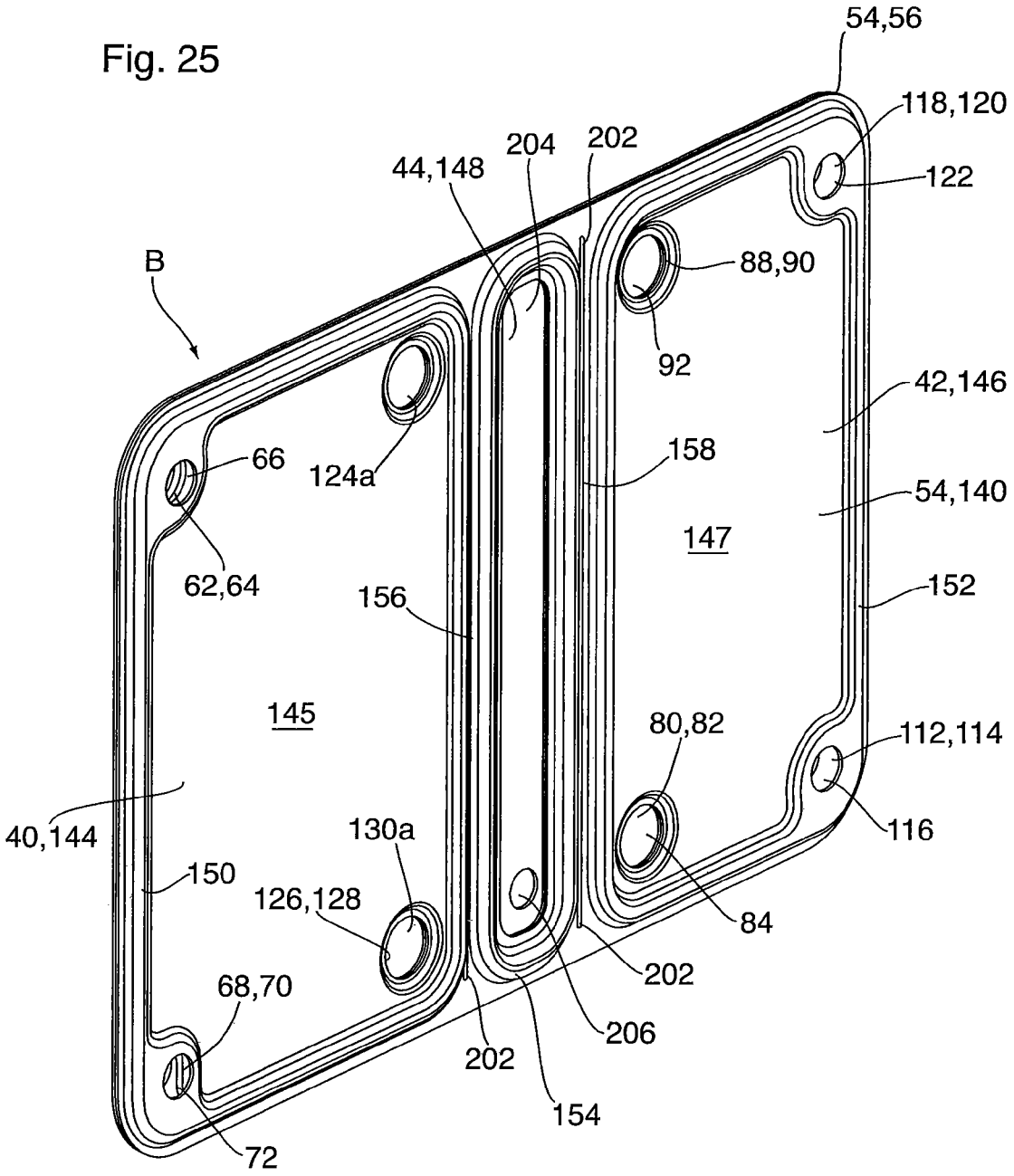
FIG. 25 is a close-up view of one embodiment of a plate pair making up the integrated core structure of the refrigeration system of FIG. 17.
Figure 26:
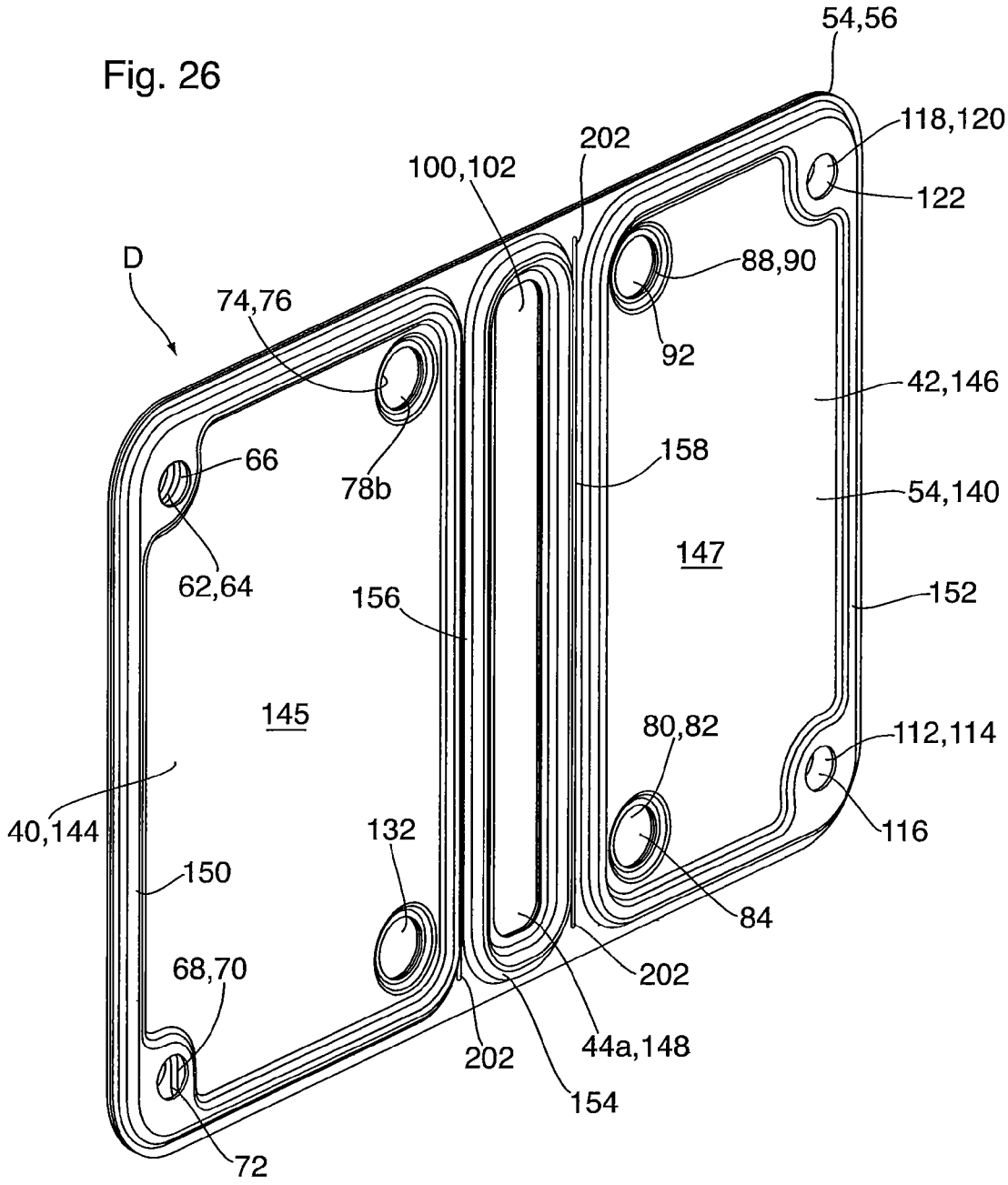
FIG. 26 is a close-up view of one embodiment of a plate pair making up the integrated core structure of the refrigeration system of FIG. 17.
Figure 27:
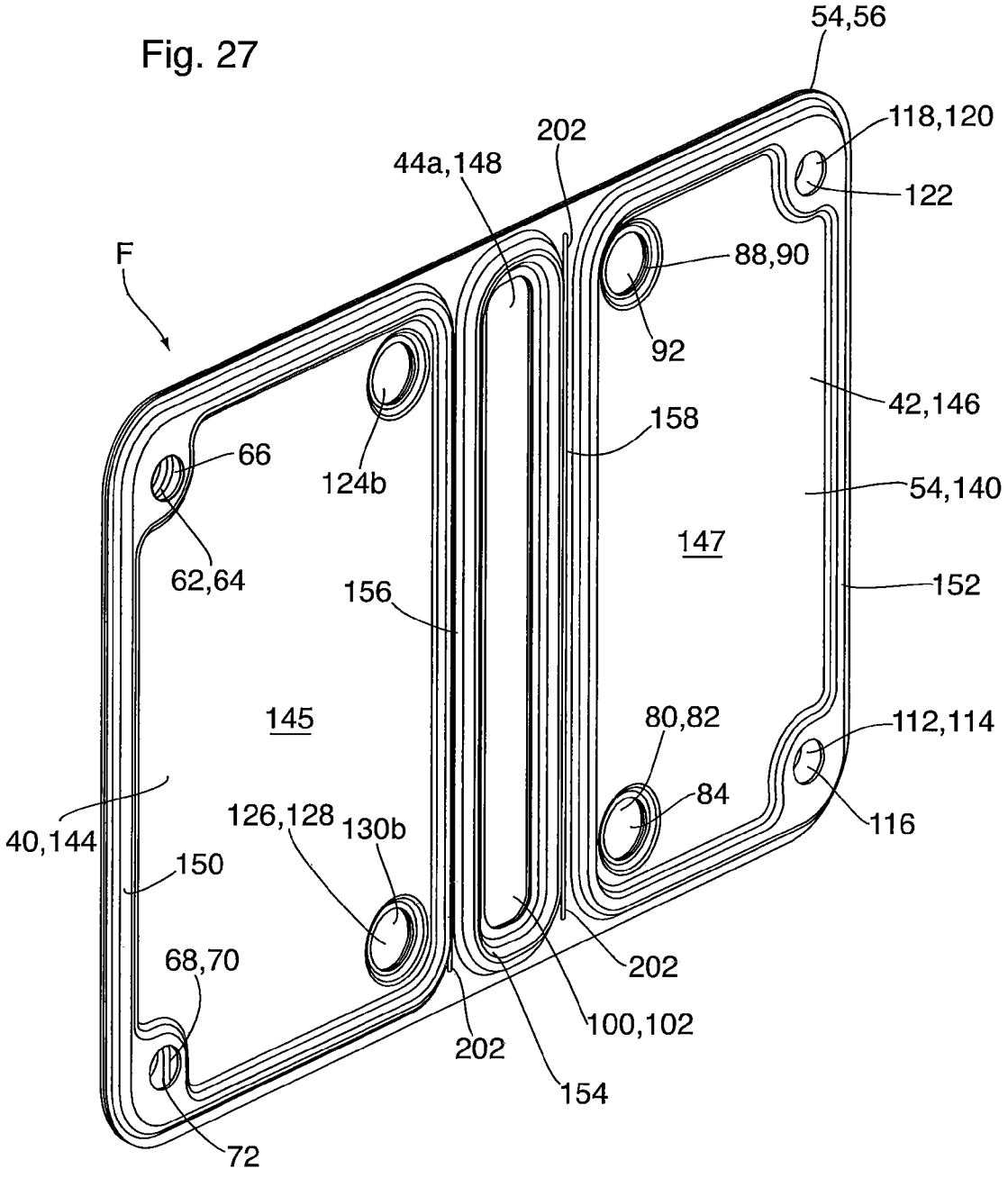
FIG. 27 is a close-up view of one embodiment of a plate pair making up the integrated core structure of the refrigeration system of FIG. 17.

FIG. 23 is an exploded view of the various plates 54, 56, 114 and 116 making up the core 12 of refrigeration system 200. In particular, FIG. 23 shows that the core 12 is made up of seven distinct groups of core plates 54, 56, labeled A to G. Each group comprises one or more plate pairs, each of the plate pairs comprising a core plate 54 and a core plate 56.

FIGS. 24-28 are enlarged views of the groups of core plates 54, 56 labeled in FIG. 23 as groups A, B, D, F and G, respectively. Each of these groups of core plates 54, 56 includes features which affect the routing of the refrigerant flow throughout the core, as now discussed in detail below.

Group A includes four plate pairs 54, 56, in which the core plates 54, 56 do not include any blind openings or partitions. Group A is identical to Group C, and is identical to Group E except that Group E includes only three plate pairs instead of four.

Group B includes one plate pair 54, 56 in which at least core plate 54 includes a blind opening 124*a* and a reservoir partition 204.

Group D includes one plate pair 54, 56 in which at least core plate 54 includes a blind opening 132.

Group F includes one plate pair 54, 56 in which at least core plate 54 includes a blind opening 124*b*.

Group G includes two plate pairs 54, 56 in which at least core plate 54 includes a refrigerant communication passage 134.

Figure 19:
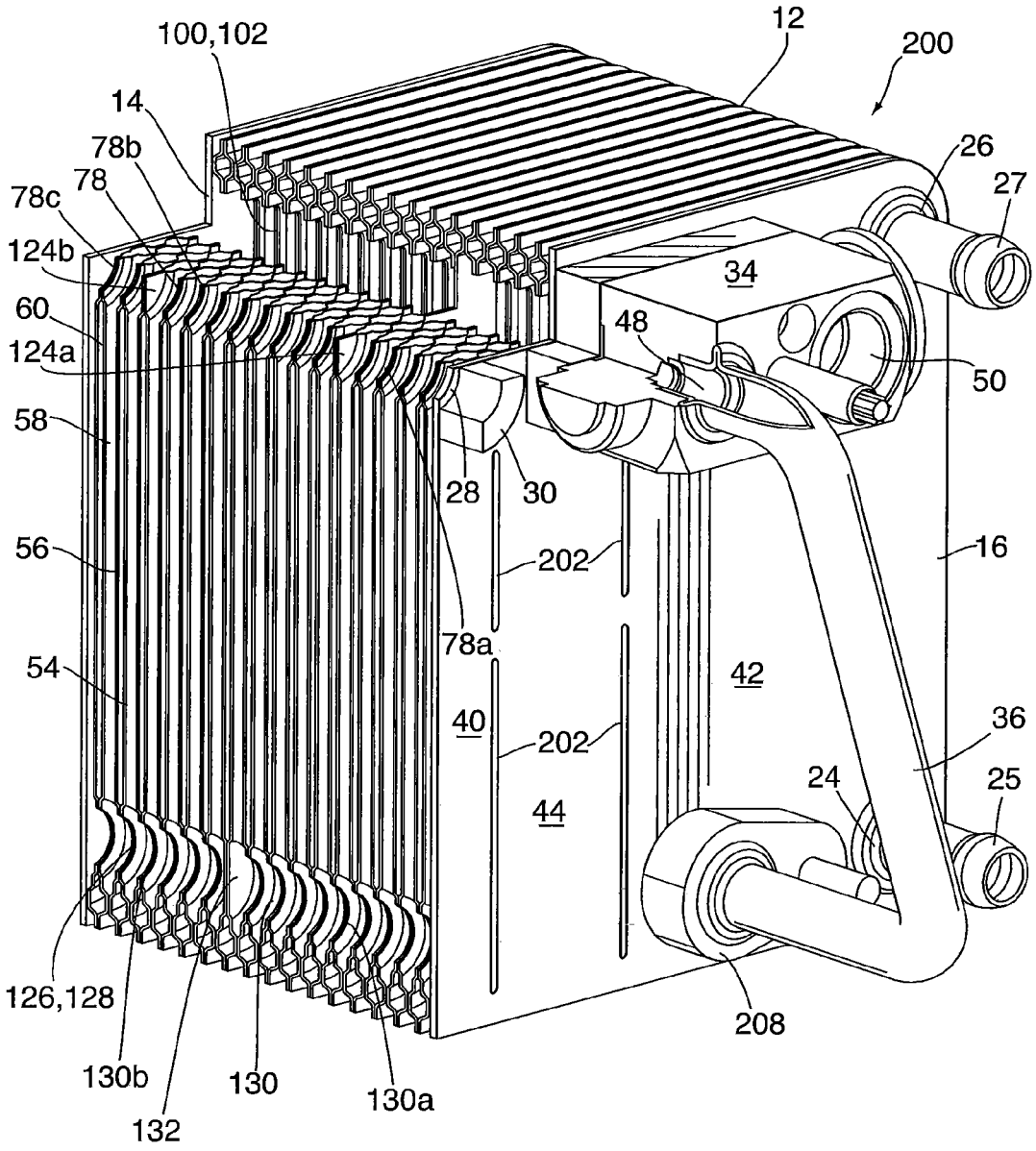
FIG. 19 is a cross-section along line 19-19' of FIG. 17.

As shown in FIGS. 19 and 20, the first refrigerant manifold space 78 of condenser 40 includes a pair of partitions 124*a* and 124*b*, each comprising a "blind" refrigerant opening 74, 76 in at least one of the core plates 54, 56. In the illustrated embodiment, the partitions 124*a*, 124*b* are each provided in a first core plate 54. The two partitions 124*a* and 124*b* divide the first refrigerant manifold space 78 into three portions, labeled 78*a*, 78*b* and 78*c* in the drawings. Portion 78*a*, extending from the refrigerant inlet 28 to the partition 124*a* (i.e. through the plate pairs of Group A), comprises a refrigerant inlet manifold of the condenser 40. The portion 78*b*, extending between partitions 124*a* and 124*b* (i.e. through the plate pairs of Groups C, D and E) comprises a turnaround manifold space, the purpose of which will be explained below. The portion 78*c*, extending from partition 124*b* to back plate 14 (i.e. through the plate pairs of Group G), comprises a refrigerant outlet manifold of condenser 40.

As shown in FIG. 19, the second refrigerant manifold space 130 of the condenser 40 is closed at both ends by the back and front plates 14, 16, and includes a partition 132 which comprises a "blind" refrigerant opening 126,128 in at least one of the core plates 54, 56. In the illustrated embodiment, the partition 132 is provided in a first core plate 54 located intermediate the first core plates 54 in which partitions 124*a*, 124*b* are provided. The partition 132 divides the second refrigerant manifold space 130 into two portions, labeled 130*a* and 130*b* in the drawings. Portion 130*a* extends from the front plate 16 to the partition 132 (i.e. through the plate pairs of Groups A, B and C), and portion 130*b* extends from the partition 132 to the back plate 14 (i.e. through the plate pairs of Groups E, F and G).

The partitions 124*a*, 124*b* and 132 cause the refrigerant to make a number of passes through the condenser 40. In particular, the arrangement shown in FIGS. 17 to 28 causes the refrigerant to make four passes as it flows through the condenser 40. As in the first embodiment, the partitions 124 and 132 may be formed by providing a removable die or punch in the tooling for one or both of the core plates 54, 56.

As best seen in the transverse cross section of FIG. 20, the first and/or second core plates 54, 56 defining the two refrigerant flow passages 58 of the condenser 40 closest to back plate 14 (i.e. Group G) are modified so as to define refrigerant communication passages 134 providing flow communication between the refrigerant outlet manifold space 130 and the interior of the refrigerant reservoir 44. These refrigerant communication passages 134 define both a refrigerant outlet 136 of the condenser 40 and a refrigerant inlet 138 of the refrigerant reservoir 44. Therefore, once the refrigerant completes four passes through the refrigerant flow passages 58 of condenser 40, it flows through communication passages 134 into the reservoir 44.

As mentioned above, the refrigerant reservoir 44 of core 12 has a partition 204 which divides the refrigerant reservoir 44 into two portions 44*a*, 44*b*, wherein the rear portion 44*a* is shown as having a greater volume than the front portion 44*b*. The partition 204 has one or more openings at its lower end to permit flow communication between the two portions 44*a*, 44*b* of refrigerant reservoir 44. In the present embodiment, one such opening 206 is provided in partition 204. Therefore, the liquid refrigerant from condenser 40 is collected in rear portion 44*a* of reservoir 44. The collected refrigerant flows into the front portion 44*b* of reservoir 44 through opening 206, and is then forced under pressure through the opening 104 in the upper end of core 12.

As will be appreciated, the arrangement of these elements in the second embodiment allows the reservoir outlet opening 104 and refrigerant inlet opening 86 of evaporator 42 to be located at opposite ends of the core 12, thereby eliminating the need for a mounting block 38 with an internal flow passage 108, and simplifying the structure of the core 12. In addition, the placement of the reservoir 44 between the condenser 40 and evaporator 42 helps to minimize heat transfer between these two components.

As in the first embodiment, the core plates 54, 56 of the second embodiment include a plurality of raised partitions to separate the condenser 40, reservoir 44 and evaporator 42. These partitions follow the description above relating to refrigeration system 10, and the following is a description of the raised partitions of first core plates 54, it being appreciated that the second core plates 56 are mirror images of plates 54, and therefore the following description also applies to the second core plates 56.

The refrigerant side 140 of first core plate 54 is provided with a plurality of raised partitions along which the first core plate 54 is sealingly joined to an adjacent second core plate 56. These partitions divide the first core plate 54 into a condenser section 144, an evaporator section 146 and a reservoir section 148, wherein the reservoir section 148 is located between the condenser section 144 and the evaporator section 146.

The condenser section 144 comprises a condenser wall 145 separating the refrigerant side 140 and the opposite coolant side of first plate 54. In the assembled core, the condenser sections 144 are aligned throughout the core 12, and the condenser wall 145 separates the refrigerant flow passages 58 of the condenser 40 from the coolant flow passages 60 of the condenser 40.

Similarly, the evaporator section 146 comprises an evaporator wall 147 separating the refrigerant side 140 and the opposite coolant side of first plate 54. In the assembled core, the evaporator sections 146 are aligned throughout the core 12, and the evaporator wall 147 separates the refrigerant flow passages 96 of the evaporator 42 from the coolant flow passages 98 of the evaporator 42.

The raised partitions include an upstanding condenser partition 150 which completely surrounds the condenser section 144 (except in Group G which includes communication passages 134) and prevents flow of refrigerant along the refrigerant side 140 of plate 54 from the condenser section 144 to the reservoir section 148. The condenser partition 150 encloses coolant openings 62, 68 and refrigerant openings 74, 126.

Further, an evaporator partition 152 surrounds the evaporator section 146 of first core plate 54, including the refrigerant openings 80, 88 and the coolant openings 112 and 118. A reservoir partition 154 completely surrounds the reservoir opening 100 (except in Group G which includes communication passages 134).

The opposite, coolant side of first core plate 54 comprises a plurality of partitions which similarly separate the condenser section 144, evaporator section 146 and reservoir section 148 from one another. In this regard, an elongate condenser partition 156 extends throughout the height of first core plate 54 and separates the condenser section 144 from the evaporator section 146 and the reservoir section 148, and an evaporator partition 158 extends throughout the height of first core plate 54 and separates the evaporator section 146 from the reservoir section 148.

Figure 28:
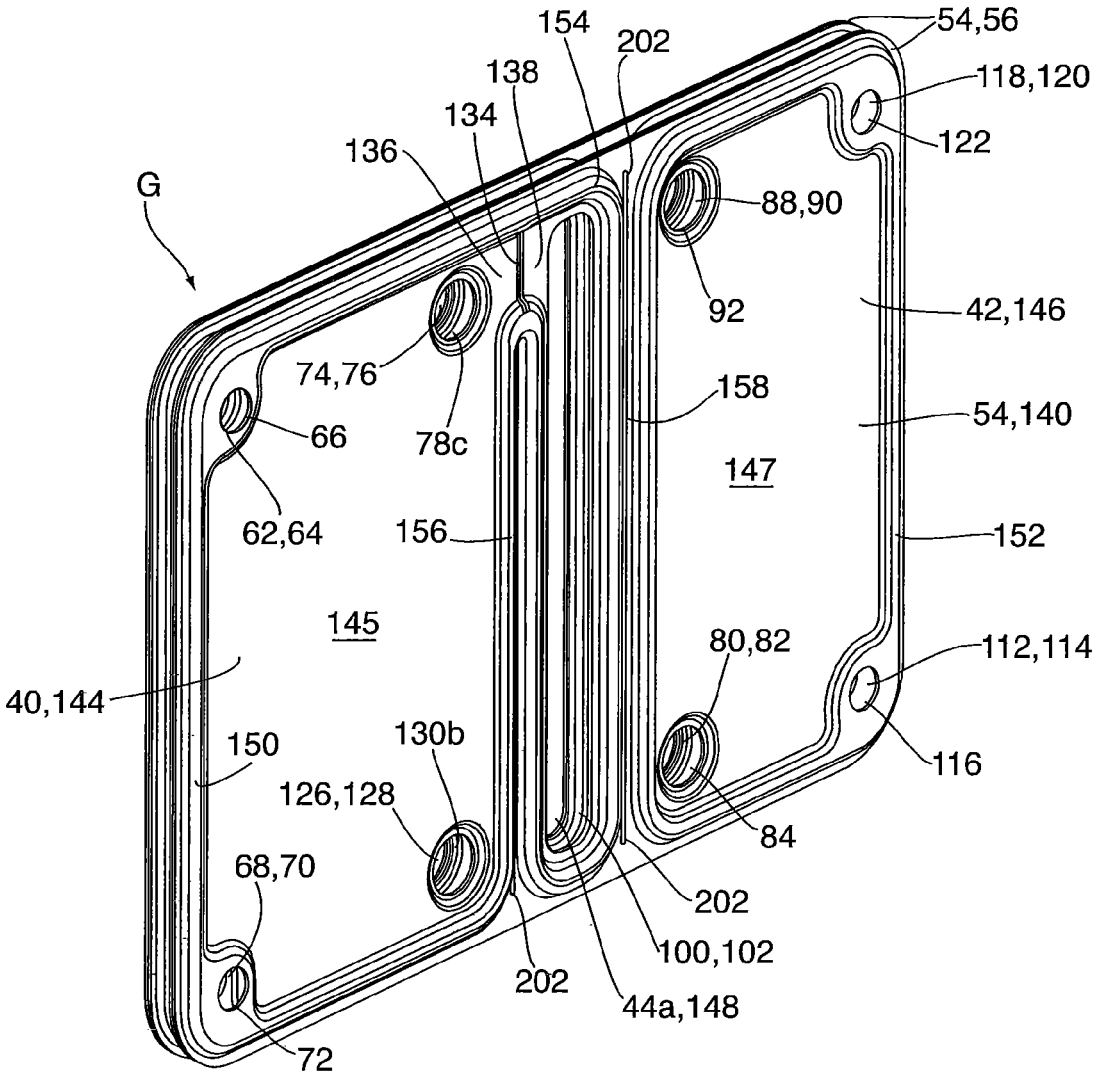
FIG. 28 is a close-up view of one embodiment of a plate pair making up the integrated core structure of the refrigeration system of FIG. 17.

In the plate pairs of Group G, shown in FIG. 28, the partitions 150 and 154 surrounding the condenser section 144 and reservoir section 148 respectively, on the refrigerant side 140 of first plate 54, are interrupted to provide the refrigerant communication passage 134, so as to permit refrigerant to flow from the outlet manifold space **130*b* of condenser 40 to the reservoir 44**.

In the present embodiment a first thermal break is provided between the condenser and the refrigerant reservoir, the first thermal break comprising the slots 202 on the left side of core 12. Also, a second thermal break is provided between the evaporator and the refrigerant reservoir, the second thermal break comprising the slots 202 on the right side of core 12.

Each thermal break comprises one or more openings in at least some of the core plates 54, 56 of the core 12, wherein the one or more openings comprising each said thermal break are in alignment with one another. In the present embodiment, the openings comprising the first thermal break (i.e. the left row of slots 202) are located in at least one of the partitions separating the condenser section 144 from the reservoir section 148. Similarly, the openings comprising the second thermal break (i.e. the right row of slots 202) are located in at least one of the partitions separating the evaporator section 146 from the reservoir section 148. For example, as shown in FIGS. 24 to 28, the slots 202 may be provided in the condenser partition 156 and evaporator partition 158, both of which protrude from the coolant side of core plate 54. The condenser partition 156 is located between the condenser partition 150 and reservoir partition 154 on the refrigerant side 140 of core plate 54, and the evaporator partition 158 is located between the evaporator partition 152 and reservoir partition 154 on the refrigerant side 140 of core plate 54. Alternatively, or in addition to slots 202 in partitions 156, 158, it may be desired to provide similar slots or apertures in one or more of partitions 150, 152, 154 for the purpose of providing thermal breaks.

The openings such as slots 202 are desirably provided in each of the plates 54, 56 making up the core 12, as well as in the back plate 14 and the front plate 16. The openings are in alignment with one another throughout stack, such that each of the thermal breaks extends completely through the core.

Although not shown in the drawings, it will be appreciated that the refrigerant and coolant flow passages of the condenser 40 and evaporator 42 may be provided with turbulence-enhancing features, as discussed above in relation to the first embodiment.

Although the invention has been described in connection with certain embodiments, it is not limited thereto. Rather, the invention includes all embodiments which may fall within the scope of the following claims.

What is claimed is:

1. A refrigeration system comprising a core, wherein the core comprises a stack of core plates and defines: (a) a condenser comprising a plurality of refrigerant flow passages and a plurality of first coolant flow passages in alternating arrangement throughout said core, the condenser further comprising a refrigerant inlet, a refrigerant outlet, a first coolant inlet, and a first coolant outlet; (b) an evaporator comprising a plurality of refrigerant flow passages and a plurality of second coolant flow passages in alternating arrangement throughout said core, the evaporator further comprising a refrigerant inlet, a refrigerant outlet, a second coolant inlet, and a second coolant outlet; and (c) a refrigerant reservoir having a refrigerant inlet and a refrigerant outlet; wherein the refrigerant outlet of the condenser is in flow communication with the refrigerant inlet of the refrigerant reservoir, and the refrigerant outlet of the refrigerant reservoir is in flow communication with the refrigerant inlet of the evaporator; wherein each of the core plates has a refrigerant side and a coolant side and includes a plurality of partitions on both the refrigerant side and the coolant side, said plurality of partitions dividing the core plate into a condenser section, an evaporator section and a reservoir section; wherein the condenser section of each said core plate comprises a condenser wall separating the refrigerant flow passages of the condenser from the first coolant flow passages, wherein the condenser sections of the core plates are aligned throughout the core; wherein the evaporator section of each said core plate comprises an evaporator wall separating the refrigerant flow passages of the evaporator from the second coolant flow passages, wherein the evaporator sections of the core plates are aligned throughout the core; wherein the refrigerant reservoir section of each said core plate comprises an aperture, wherein said apertures are aligned throughout the core; wherein the refrigerant side of at least one of said core plates includes a refrigerant communication passage providing flow communication between the refrigerant outlet of the condenser section and the refrigerant inlet of the reservoir section.

2. The refrigeration system of claim 1, wherein at least one of said partitions on the refrigerant side divides the condenser section from the refrigerant reservoir, and wherein the refrigerant communication passage comprises an interruption in said at least one partition.

3. The refrigeration system of claim 1, wherein the condenser wall of each said core plate has a first refrigerant opening and a second refrigerant opening, and wherein the first refrigerant openings align throughout the core to form a first refrigerant manifold space of the condenser, and wherein the second refrigerant openings align throughout the core to form a second refrigerant manifold space of the condenser.

4. The refrigeration system of claim 1, wherein at least one of the first refrigerant manifold space and the second refrigerant manifold space includes an internal partition so as to direct flow of the refrigerant to follow a multi-pass refrigerant flow path through the condenser;

wherein the multi-pass refrigerant flow path includes a first pass in which the refrigerant inlet of the condenser is located, and a last pass in which the refrigerant outlet of the condenser is located; and wherein the last pass is comprised of said at least one core plate including a refrigerant communication passage, and the other passes of the multi-pass refrigerant flow path are comprised of core plates in which the condenser is sealed from the refrigerant reservoir by at least one of said partitions.

5. The refrigeration system of claim 1, wherein the refrigerant inlet of the condenser is located above the refrigerant outlet of the condenser.

6. The refrigeration system of claim 1, wherein the refrigerant outlet of the refrigerant reservoir is located below the refrigerant inlet of the refrigerant reservoir.

7. The refrigeration system of claim 1, wherein the refrigerant inlet of the evaporator is located below the refrigerant outlet of the evaporator.

8. The refrigeration system of claim 1, wherein the flow communication between the refrigerant outlet of the refrigerant reservoir and the refrigerant inlet of the evaporator is provided through a return passage located outside the core.

9. The refrigeration system of claim 8, further comprising a thermal expansion valve located in the return passage between the refrigerant outlet of the refrigerant reservoir and the refrigerant inlet of the evaporator.

10. The refrigeration system of claim 9, wherein the thermal expansion valve is located in an upper portion of the core, and wherein the refrigeration system further comprises an external passage for delivering the refrigerant from the thermal expansion valve to the refrigerant inlet of the evaporator.

11. The refrigeration system of claim 1, wherein each of the core plates further comprises a peripheral flange, and wherein the peripheral flanges of adjacent core plates in said core are sealingly joined together.

12. The refrigeration system of claim 1, wherein corresponding partitions of adjacent core plates are sealingly joined together so as to provide separation of the condenser section, the evaporator section and the refrigerant reservoir from one another.

13. The refrigeration system of claim 1, further comprising a back plate and a front plate, wherein one of the back plate and the front plate includes an external inlet connection for the refrigerant, wherein the external inlet connection provides flow communication with the refrigerant inlet of the condenser.

14. The refrigeration system of claim 13, further comprising a compressor having an inlet in flow communication with the refrigerant outlet of the evaporator and an outlet in flow communication with the external inlet connection of the front plate.

15. The refrigeration system of claim 13, wherein the front plate is further provided with a plurality of coolant fittings, each of which is in flow communication with one of the first coolant inlet, the first coolant outlet, the second coolant inlet and the second coolant outlet.

16. The refrigeration system of claim 1, wherein the evaporator and the reservoir are both located adjacent to the condenser, and wherein the evaporator is located above the refrigerant reservoir.

17. The refrigeration system of claim 1, wherein the evaporator and the condenser are both located adjacent to the refrigerant reservoir, and wherein the refrigerant reservoir is located between the evaporator and the condenser.

18. The refrigeration system of claim 17, wherein a first thermal break is provided between the condenser and the refrigerant reservoir, and a second thermal break is provided between the evaporator and the refrigerant reservoir;

wherein each said thermal break comprises one or more openings in at least some of the core plates of the stack, wherein the one or more openings comprising each said thermal break are in alignment with one another;

wherein the openings comprising the first thermal break are located in at least one of the partitions separating the condenser section from the reservoir section; and wherein the openings comprising the second thermal break are located in at least one of the partitions separating the evaporator section from the reservoir section.

19. The refrigeration system of claim 18, wherein said one or more openings are provided in all the core plates of the stack, such that the first and second thermal breaks extend completely through the core.

20. The refrigeration system of claim 1, wherein the refrigerant reservoir includes a partition, wherein said partition is provided in one said core plate in which the aperture defining the refrigerant reservoir section is smaller than the apertures in the other core plates of the core.

* * * * *